US007379287B2

(12) United States Patent
Fujimoto

(10) Patent No.: US 7,379,287 B2
(45) Date of Patent: May 27, 2008

(54) SHIELDING METHOD AND SHIELDING APPARATUS

(75) Inventor: Keisuke Fujimoto, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 334 days.

(21) Appl. No.: 10/968,934

(22) Filed: Oct. 21, 2004

(65) Prior Publication Data

US 2005/0088796 A1 Apr. 28, 2005

(30) Foreign Application Priority Data

Oct. 23, 2003 (JP) ..... 2003-363887

(51) Int. Cl.
*H01H 47/00* (2006.01)
*H01F 13/00* (2006.01)

(52) U.S. Cl. ..... 361/267

(58) Field of Classification Search ..... 361/143, 361/267, 142; 399/328, 69; 219/619
See application file for complete search history.

(56) References Cited

U.S. PATENT DOCUMENTS 5,583,726 A * 12/1996 Mizoshita et al. ..... 360/321
6,147,336 A * 11/2000 Ushijima et al. ..... 219/601
6,285,188 B1 * 9/2001 Sakakura ..... 324/318
6,323,636 B1 * 11/2001 Cattaneo et al. ..... 324/127
6,678,498 B2 * 1/2004 Terada et al. ..... 399/328
6,810,230 B2 * 10/2004 Imai et al. ..... 399/328
6,819,904 B2 * 11/2004 Terada et al. ..... 399/328
6,849,838 B2 * 2/2005 Shimizu et al. ..... 219/635
6,872,925 B2 * 3/2005 Asakura et al. ..... 219/619
6,882,807 B2 * 4/2005 Sakagami ..... 399/69
6,888,113 B2 * 5/2005 Monda et al. ..... 219/619
6,901,235 B2 * 5/2005 Shimizu et al. ..... 399/328
6,933,722 B2 * 8/2005 Tsuda et al. ..... 324/318
7,005,619 B2 * 2/2006 Fujii et al. ..... 219/619
2002/0190060 A1 * 12/2002 Imai et al. ..... 219/619
2006/0099001 A1 * 5/2006 Asakura et al. ..... 399/69

FOREIGN PATENT DOCUMENTS

JP 58-37676 8/1783
JP 02159595 A * 6/1990
JP 2001-5315 1/2001
JP 2002143126 A * 5/2002
JP 2005123010 A * 5/2005

OTHER PUBLICATIONS

English Language Abstract of JP2001-5315.

* cited by examiner

*Primary Examiner*—Ronald W Leja
(74) *Attorney, Agent, or Firm*—Greenblum & Bernstein, P.L.C.

(57) ABSTRACT

A canceling exciting coil is supported by a coil supporting member of electrically insulating material fitted to an arch core. A canceling current Ic of opposite phase to a main current I flowing in the magnetic field generation circuit of the exciting coil by means of an exciting circuit is made to flow in a canceling magnetic field generation circuit provided with a canceling exciting coil, and generates canceling flux Mc. The idle component of the AC voltage generated in the canceling exciting coil is minimized by changing the number of turns n, coil inner area, and winding distribution of the canceling exciting coil, and adjusting canceling current Ic.

34 Claims, 13 Drawing Sheets

SHIELDING METHOD AND SHIELDING APPARATUS

BACKGROUND OF THE INVENTION

1. Field of the Invention

The present invention relates to a shielding method and shielding apparatus that shield leakage flux leaking from a magnetic circuit that generates alternating flux.

2. Description of the Related Art

One heating method is the IH (induction heating) method, whereby a body to be heated is induction-heated by a high-frequency magnetic field generated by causing a high-frequency current to flow in an exciting coil of a magnetic field generation circuit. A fixing apparatus that uses an induction heating apparatus employing this IH method as the heating means of the toner fixing section in an image forming apparatus is currently known (for example, Unexamined Japanese Patent Publication No.2001-5315).

The fixing apparatus described in Unexamined Japanese Patent Publication No.2001-5315 is configured, for example, so that the exciting coil of a magnetic field generation circuit is located in the vicinity of a fixing belt or fixing roller, a high-frequency current is caused to flow in this exciting coil, and the surface of the aforementioned fixing belt or fixing roller is induction-heated. Compared with a fixing apparatus in which the heating unit comprises a halogen lamp, a fixing apparatus that uses an induction heating apparatus employing this IH method as a heating unit has the advantages of higher thermal efficiency and lower energy loss, making possible rapid heating at low power consumption.

In an induction heating apparatus employing this IH method, there is generally a requirement for shielding of leakage flux leaking from the magnetic circuit that generates the alternating flux. As such a leakage flux shielding method, a method is currently known whereby a doughnut-shaped shielding ring of a conductive material such as aluminum is fitted around the exciting coil that is the source of leakage flux generation (for example, Examined Japanese Patent Publication No.SHO 58-37676).

In the method described in Examined Japanese Patent Publication No.SHO 58-37676, leakage flux is reduced based on the following principle. Namely, when an exciting coil provided in the magnetic field generation circuit of an induction heating apparatus is energized, a magnetic field is formed due to this energization, and an induction current is generated in the aforementioned shielding ring. Then, according to Lentz's law, when the flux linkage passing through the shielding ring changes, electromotive force arises in the direction preventing flux change, and an induction current flows in the shielding ring. The magnetic field generated from the shielding ring by this induction current is a magnetic field opposite in direction to the magnetic field generated from the exciting coil. Consequently, the magnetic field generated from the shielding ring and the magnetic field generated from the exciting coil cancel each other out, and generation of the aforementioned leakage flux is reduced.

The lower the resistance value of the shielding ring, the larger is the current that flows in the shielding ring, and the greater is the leakage flux reduction effect. However, making this shielding ring resistance value zero is difficult in practice. Therefore, with a conventional shielding method using this kind of shielding ring, it has not been possible to completely shield the above-described leakage flux.

Also, a characteristic of a high-frequency current is that, due to the skin effect, current does not flow deep within the conductor of the shielding ring, but mostly flows in the surface of the conductor. As a result, a problem with the above-described conventional shielding method is that, because of this skin effect phenomenon the induction current flowing in the shielding ring does not increase very much, and the leakage flux reduction effect does not improve, even if the thickness of the shielding ring is increased beyond a certain point.

SUMMARY OF THE INVENTION

The present invention has been implemented taking into account the points described above, and it is an object of the present invention to provide a shielding method and shielding apparatus that enable leakage flux leaking from a magnetic circuit that generates alternating flux to be effectively shielded.

The present invention passes a canceling current corresponding to alternating flux generated by a magnetic circuit through a canceling magnetic field generation circuit, and generates canceling flux for canceling leakage flux.

According to this configuration, as a result of the aforementioned canceling current corresponding to alternating flux being made to flow, canceling flux for canceling the aforementioned leakage current is generated by the aforementioned canceling magnetic field generation circuit. Therefore, in this shielding apparatus, leakage flux leaking from the aforementioned magnetic circuit that generates alternating flux is canceled by the aforementioned canceling flux, and can be effectively shielded.

The aforementioned magnetic circuit is provided with a magnetic field generation circuit that has an exciting coil through which an excitation current is passed and that generates aforementioned alternating flux, and it is desirable for the aforementioned canceling current to be an alternating current of the opposite phase to the phase of the aforementioned excitation current.

According to this configuration, as a result of the aforementioned canceling current of the opposite phase to the phase of the current flowing in the exciting coil being passed through the aforementioned canceling exciting coil, canceling flux for canceling the aforementioned leakage current is generated. Therefore, in this shielding apparatus, leakage flux leaking from the aforementioned magnetic circuit that generates alternating flux is canceled by the aforementioned canceling flux, and can be effectively shielded.

It is desirable for the aforementioned magnetic field generation circuit and the aforementioned canceling magnetic field generation circuit to form a closed circuit.

According to this configuration, a current identical to the current flowing in the aforementioned magnetic field generation circuit flows in the aforementioned canceling magnetic field generation circuit as a canceling current. Therefore, in this shielding apparatus, the aforementioned leakage flux leaking from the magnetic circuit that generates alternating flux and the aforementioned canceling flux have a predetermined proportional relationship, and it is possible to generate easily canceling flux of a magnitude corresponding to the aforementioned leakage flux.

It is desirable for the canceling current that flows in the aforementioned canceling exciting coil to be processed so that the aforementioned leakage flux and the aforementioned canceling flux become equal.

It is desirable for the aforementioned canceling exciting coil to be installed via an electrical insulator at a position at which the aforementioned canceling flux overlaps the aforementioned leakage flux.

According to this configuration, since the aforementioned canceling flux overlaps the aforementioned leakage flux, the aforementioned leakage flux leaking from the magnetic circuit that generates alternating flux can be canceled effectively by the aforementioned canceling flux. Also, in this configuration, since the aforementioned canceling exciting coil is installed via the aforementioned insulator in which an induction current does not flow, the aforementioned canceling flux is not disturbed, and the aforementioned leakage flux leaking from the magnetic circuit that generates alternating flux can be canceled effectively by the aforementioned canceling flux.

DETAILED DESCRIPTION OF THE PREFERRED EMBODIMENTS

Embodiment 1

Figure 1:
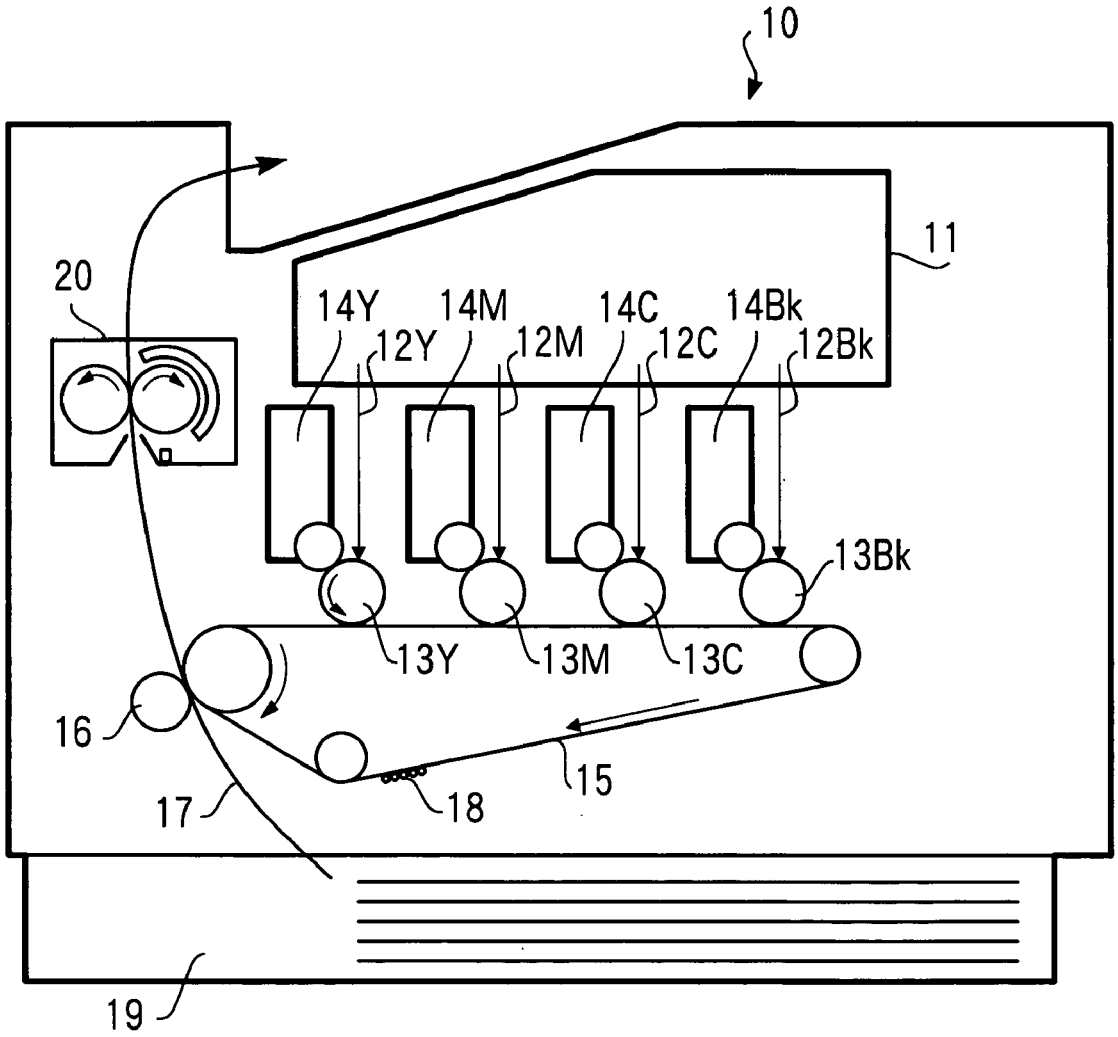
FIG. 1 is a schematic configuration diagram showing the overall configuration of an image forming apparatus as an example in which a shielding apparatus of the present invention is applied.

FIG. 1 is an overall configuration diagram of an image forming apparatus as an example in which a shielding apparatus of the present invention is applied. This image forming apparatus is configured to enable formation of a full-color image combining images of four colors: Y (yellow), M (magenta), C (cyan), and Bk (black). Here, of the members shown in FIG. 1, members involved only in formation of an image of a specific color have the characters Y, M, C, or Bk appended to their respective reference codes to indicate the image color with which each is concerned.

As shown in FIG. 1, image forming apparatus 10 is provided with an exposure apparatus 11, photosensitive bodies 13Y, 13M, 13C, and 13Bk, developing units 14Y, 14M, 14C, and 14Bk, an intermediate transfer belt 15, secondary transfer roller 16, paper feed unit 19, and fixing apparatus 20.

In FIG. 1, exposure apparatus 11 outputs four laser beams 12Y, 12M, 12C, and 12Bk in accordance with image signals. By this means, latent images are formed on the surfaces of photosensitive bodies 13Y, 13M, 13C, and 13Bk by laser beams 12Y, 12M, 12C, and 12Bk. Developing units 14Y, 14M, 14C, and 14Bk develop the latent images formed on the surfaces of photosensitive bodies 13Y, 13M, 13C, and 13Bk by fixing toner to these latent images. Toners of four colors—Y (yellow), M (magenta), C (cyan), and Bk (black)—are stored separately in developing units 14Y, 14M, 14C, and 14Bk.

Toner images of four colors formed on photosensitive bodies 13Y, 13M, 13C, and 13Bk are superimposed sequentially onto the surface of intermediate transfer belt 15, which is suspended on a plurality of supporting rollers and moved by rotation in the direction of the arrow in the drawing, and undergo primary transfer. This primary transfer is performed by applying a primary transfer bias to the rear surface of intermediate transfer belt 15 by means of primary transfer rollers (not shown) that are positioned opposite photosensitive bodies 13Y, 13M, 13C, and 13Bk and therewith sandwich intermediate transfer belt 15. The four-color toner image 18 transferred onto intermediate transfer belt 15 by means of this primary transfer undergoes secondary transfer onto recording paper 17 fed from paper feed unit 19 in a secondary transfer unit in which a drive-side supporting roller and secondary transfer roller 16 are opposed.

Secondary transfer roller 16 is installed so as to allow freedom of contact or detachment with respect to intermediate transfer belt 15. Secondary transfer of toner image 18 onto recording paper 17 is performed by applying a secondary transfer bias to the rear surface of recording paper 17 by means of secondary transfer roller 16 while toner image 18 and recording paper 17 are sandwiched between intermediate transfer belt 15 and secondary transfer roller 16. Paper feed unit 19 feeds recording paper 17 in synchronization with the timing of this secondary transfer.

Recording paper 17 onto which toner image 18 has been transferred is sent to fixing apparatus 20. Fixing apparatus 20 fixes toner image 18 onto recording paper 17 by performing hot pressing of recording paper 17 onto which toner image 18 has been transferred at a fixing temperature of 170° C., for example. Recording paper 17 onto which toner image 18 has been fixed is ejected into an output tray formed in the top surface of image forming apparatus 10.

Figure 2:
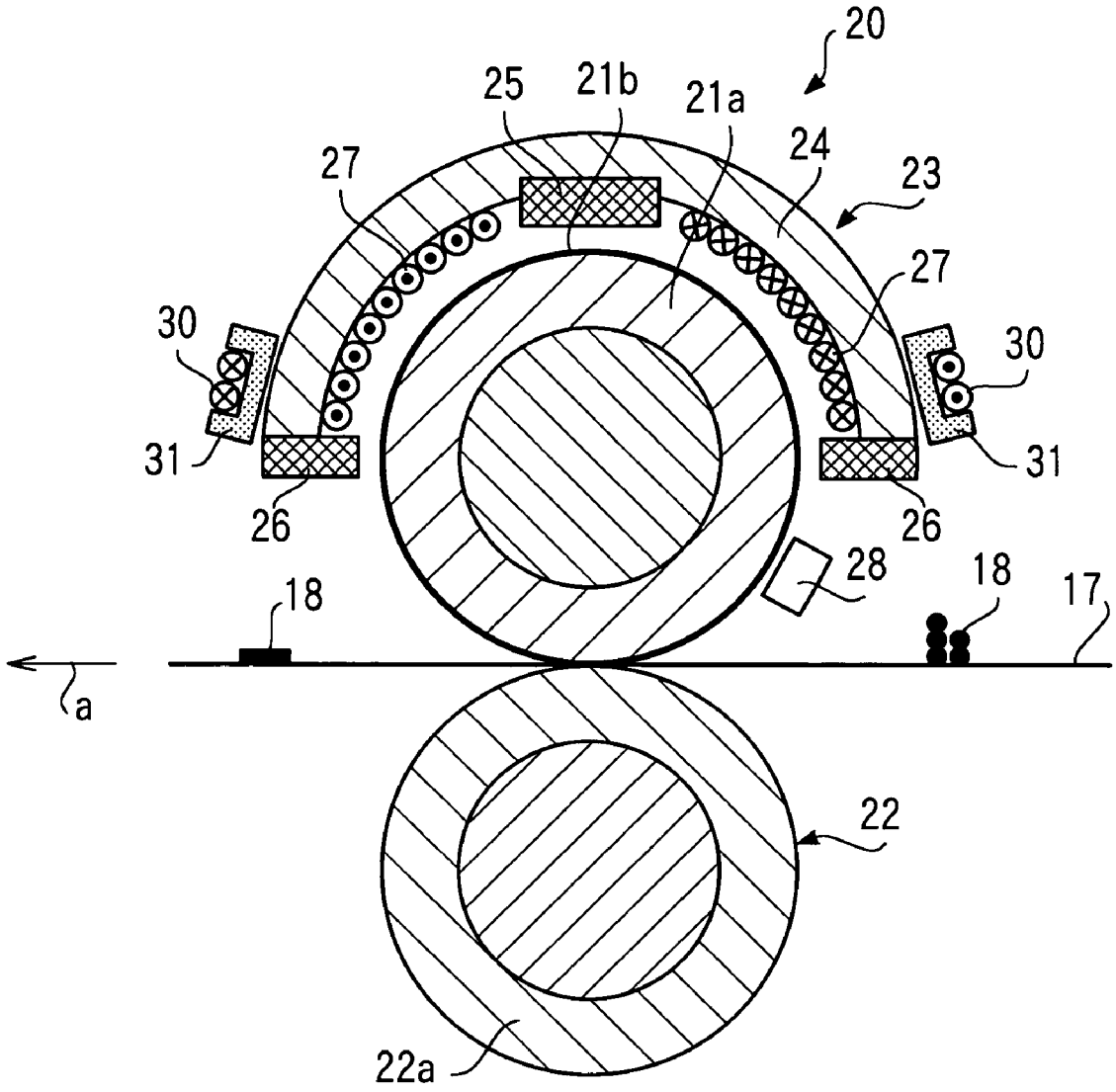
FIG. 2 is a cross-sectional diagram showing the configuration of a fixing apparatus as an example in which a shielding apparatus of the present invention is applied.

Fixing apparatus 20 uses an induction heating apparatus as a heating unit. FIG. 2 is a cross-sectional diagram showing the configuration of the essential parts of this fixing apparatus 20. This fixing apparatus 20 is provided with a heating roller 21, pressure roller 22, and excitation unit 23.

Heating roller 21 is composed of a highly thermally insulative and elastic insulation maintenance layer 21*a* and a heating element layer 21*b* layered around a core of aluminum or the like. Pressure roller 22 is composed of a silicone rubber layer 22*a* around a core of aluminum or the like. Heating roller 21 is axially supported so as to be free to rotate by a rotating shaft (not shown).

Pressure roller 22 is axially supported so as to be free to rotate by a rotating shaft (not shown), so that silicone rubber layer 22*a* presses against the surface of heating roller 21. By means of this pressure of pressure roller 22 on heating roller 21, a fixing nip is formed where these rollers are in contact. Also, pressure roller 22 is configured so that heating roller 21 is driven rotationally by being rotated in the clockwise direction in FIG. 2 by a drive mechanism (not shown).

Figure 3:
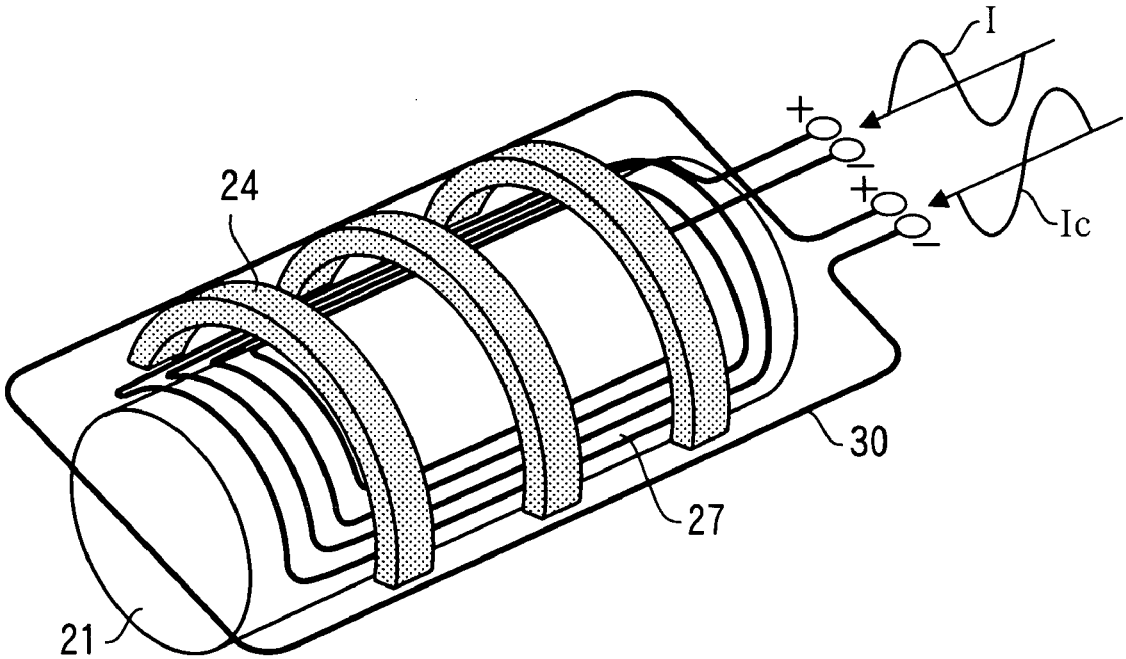
FIG. 3 is a schematic oblique projection of a shielding apparatus in which the fixing apparatus in FIG. 2 is applied.

Excitation unit 23 is composed of an arch core 24, center core 25, a pair of side cores 26, an exciting coil 27, and so forth. An arch core 24 is formed with a semicircular arch-shaped overall cross-section so as to cover half the outer circumferential surface of heating roller 21, and as shown in FIG. 3, a plurality of arch cores 24 are provided at predetermined intervals in the axial direction of heating roller 21. Center core 25 is provided along the axial direction of heating roller 21 so as to support the center part of the inner circumferential surface of each arch core 24. A pair of side cores 26 are provided along the axial direction of heating roller 21 so as to support both ends of each arch core 24. It is desirable for the material of arch cores 24, center core 25, and side cores 26 to be a material with high magnetic permeability and resistivity, such as ferrite or permalloy.

Exciting coil 27 is configured by bundling a predetermined number of wire rods comprising conductor wires whose surface is insulated. This exciting coil 27 is positioned so as to loop by being extended in the axial direction of heating roller 21, as shown in FIG. 3, between center core 25 and side cores 26 on the inner circumferential surface side of arch cores 24. Also, exciting coil 27 is installed so as to form a predetermined gap (in the example in the drawing, approximately 3 mm) with respect to the external circumferential surface of heating roller 21, and, as shown in FIG. 4, a magnetic circuit 29 is formed with exciting coil 27, arch core 24, center core 25, side cores 26, and heating element layer 21*b* of heating roller 21 as a flux path.

In FIG. 2, heating roller 21 of fixing apparatus 20 is rotated in the clockwise direction by a drive mechanism (not shown). Pressure roller 22 is driven rotationally in the anticlockwise direction by rotation of heating roller 21. When a high-frequency current is passed through exciting coil 27 from an exciting circuit (not shown), heating element layer 21*b* of heating roller 21 adjacent to and opposite exciting coil 27 is induction-heated by an induction field. When recording paper 17 is transported into the transfer nip between heating roller 21 and pressure roller 22 in this state, toner image 18 transferred onto recording paper 17 is heated by heating roller 21, and also compressed by heating roller 21 and pressure roller 22, and is fixed onto recording paper 17. The fixing temperature of toner image 18 in this fixing apparatus 20 is controlled so that an optimum temperature is maintained based on the detected value of a temperature sensor 28 that detects the surface temperature of heating roller 21.

Figure 4:
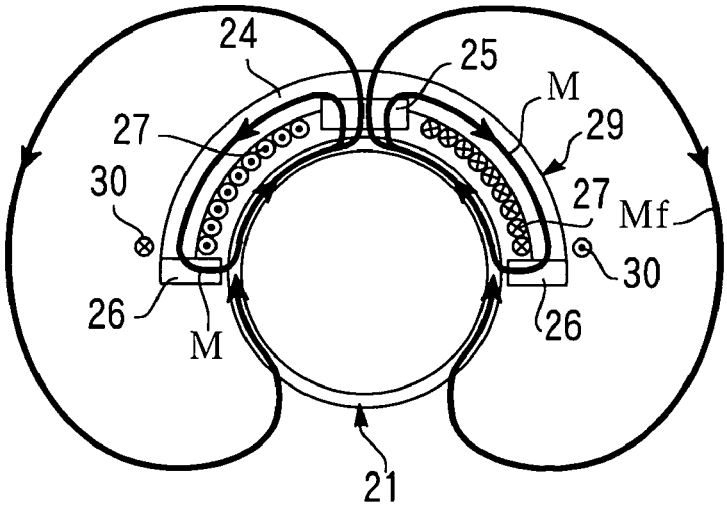
FIG. 4 is a schematic explanatory drawing for explaining the flow of main flux and leakage flux of a shielding apparatus in which the fixing apparatus in FIG. 2 is applied.

As shown in FIG. 4, when a high-frequency current is passed through exciting coil 27, main flux M is generated in magnetic circuit 29. Then, leakage flux Mf that leaks away from that flux path is generated around this main flux M. This kind of leakage flux Mf is essentially unwanted, and therefore should preferably be shielded so that it does not cause adverse effects.

Thus, the present inventors conducted experiments for shielding leakage flux Mf by means of various heretofore known shielding methods. However, as conventional shielding methods are generally methods whereby shielding is performed by forming a flux path for leakage flux Mf by means of a shielding ring comprising semiconductors or a shielding plate of magnetic material, it was not possible to shield leakage flux Mf completely.

A shielding method and apparatus of the present invention enable leakage flux Mf to be shielded completely without using an above-described shielding ring, shielding plate, or the like. First, a description will be given of the configuration common to shielding apparatuses according to each of the embodiments of the present invention described hereinafter.

As shown in FIG. 2 through FIG. 6, shielding apparatuses according to each of the embodiments of the present invention are provided with a canceling exciting coil 30. This canceling exciting coil 30 is configured by bundling a predetermined number of wire rods comprising conductor wires whose surface is insulated, as with exciting coil 27, and is supported by a coil supporting member 31 of electrically insulating material fitted to arch core 24.

Figure 5:
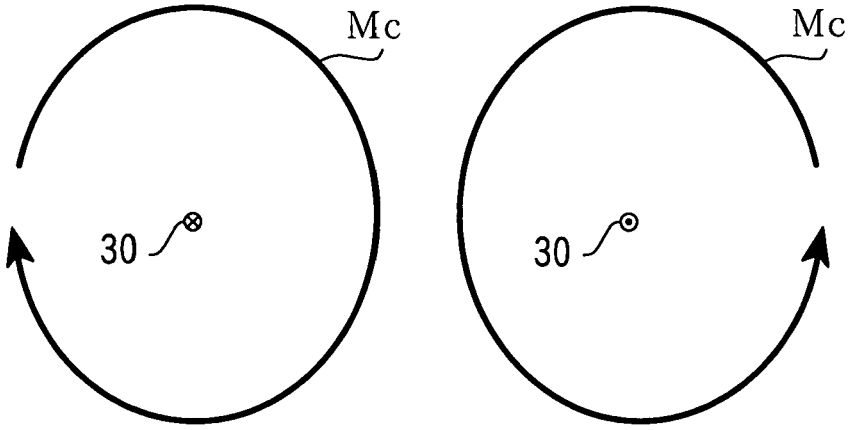
FIG. 5 is a schematic explanatory drawing for explaining the flow of canceling flux of a shielding apparatus in which the fixing apparatus in FIG. 2 is applied.

As shown in FIG. 3, a canceling current Ic whose phase is approximately the opposite of the phase of main current I flowing in the magnetic field generation circuit of exciting coil 27 is passed through canceling exciting coil 30 by means of a canceling magnetic field generation circuit described later herein. When canceling current Ic is passed through canceling exciting coil 30, a canceling flux Mc for canceling leakage flux Mf is generated. As shown in FIG. 5, the direction of this canceling flux Mc is the opposite of the direction of leakage flux Mf leaking from main flux M generated by the magnetic field generation circuit of exciting coil 27.

The magnitude of canceling flux Mc can be adjusted by changing the magnitude and phase of canceling current Ic corresponding to main current I, or the number of turns n, coil inner area, and winding distribution of canceling exciting coil 30, so as to become equal to leakage flux Mf leaking outside canceling exciting coil 30. When leakage flux Mf leaking outside canceling exciting coil 30 is completely canceled by canceling flux Mc, the total flux passing through canceling exciting coil 30 becomes 0.

When this happens, mutually induced electromotive force Vf due to mutual induction between exciting coil 27 and canceling exciting coil 30, and self-induced electromotive force VL due to canceling current Ic, cancel each other out, and therefore induced electromotive force Vi generated between the terminals of canceling exciting coil 30 becomes 0. Thus, with regard to adjustment of the magnitude of canceling flux Mc, in specific terms, the magnitude and phase of canceling current Ic corresponding to main current I, or the number of turns n, coil inner area, and winding distribution of canceling exciting coil 30, are adjusted so that the inter-terminal voltage of canceling exciting coil 30 when canceling current Ic is passed through canceling exciting coil 30 is minimized. As an adjustment guideline, it is known that, generally, with electromagnetic waves of 10 kHz to 10

MHz, if the electric field strength at a point 30 m from a device is less than 1 mV/m, the effect on other electronic devices is small.

Dividing this electric field strength by characteristic impedance 376.7 Ω to convert to magnetic field strength, as is generally done, gives 2.65 μN/Am. When this magnetic field strength is generated by a coil, the magnetic field strength is greatest on the coil axis in the vicinity of the coil, and this strength H is expressed as follows, using the distance from the coil center, r, the magnetic dipole moment of the coil, m, and the permeability of air, μ:

$$H=m/(2\times\pi\times\mu\times r^3)$$

Here, if the radius of a circular loop coil that produces a far magnetic field equivalent to that of canceling exciting coil 30 is defined as equivalent circular loop radius r2, and a magnetic dipole moment of strength m is assumed to be located coaxially at the center of a radius r2 coil, by integrating all r2 outer flux, the following relationship between total flux generated outside the coil, Φ, and magnetic dipole moment m is obtained:

$$\Phi=m/(2\times r2)$$

Meanwhile, using frequency f, number of turns n of the canceling exciting coil, and imaginary unit j, induced electromotive force Vi generated in canceling exciting coil 30 is as follows:

$$Vi=2\times\pi\times f\times\Phi\times j$$

and therefore to make the magnetic field strength smaller than 2.65 μN/Am at r=30 m, making the following subsitution, $$\mu=4\times\pi\times10^{-7}N/A^2$$

the following should be used:

$$|Vi|<0.000001774799\times f\times n/r2(V)$$

Preferably, if $$|Vi|<9.870414\times10^{-13}\times f\times n/r2(V)$$

is used, the magnetic field strength at point r=0.2 m can be made less than 4.974 μN/Am.

As an optimal value, if Vi=0, the total flux passing through canceling exciting coil 30 is made 0. However, AC voltage Va actually generated at both ends of canceling exciting coil 30 is the sum of the complex vectors of Vr, the product of the DC resistance component and canceling current Ic of canceling exciting coil 30, and Vi, and therefore even if Vi is 0, Ic is not 0, and consequently Vr is generated and is not 0. Therefore, if Vr can be ignored with respect to the Vi reference value, Vi is found by measuring the DC resistance component of canceling exciting coil 30 beforehand with a DC resistance meter or the like, and finding the difference of the vectors of AC voltage Va generated at both ends of canceling exciting coil 30 when canceling current Ic is caused to flow, and Vr.

Equivalent circular loop radius r2 is found from the shape of canceling exciting coil 30 using the following equation, taking the total flux created in outer area S of canceling exciting coil 30 by a magnetic dipole moment of strength m located at the origin and m/(2×r2) as equal.

$$r2=\frac{2\pi}{\iint_S \frac{1}{(x^2+y^2)^{\frac{3}{2}}}dxdy}$$

Specifically, in the case of a square of sides 2*a*, $$r2=\sqrt{2}\pi a/4\cong1.110720735a$$

and for a rectangular coil of sides 2*a* and 2*b*, $$r2=\frac{\pi ab}{2\sqrt{a^2+b^2}}\cong1.570796327\frac{ab}{\sqrt{a^2+b^2}}$$

Here, when the total flux passing through canceling exciting coil 30 is not made 0, and only a magnetic field generated at a distance is canceled, the magnitude of canceling flux Mc is set so that a far magnetic field component for which the magnetic field strength is inversely proportional to the cube of the distance from the shielding apparatus becomes equal to the magnitude of leakage flux Mf. Specifically, the ratio of a far magnetic field component of canceling flux Mc to canceling flux Mc is taken as far magnetic field coefficient η, and the sum of mutually induced electromotive force Vf generated by leakage flux Mf in canceling exciting coil 30 and the product of self-induced electromotive force VL generated by canceling current Ic and η is made to become smaller than a predetermined value. That is to say, ideally, $$|Vf+\eta VL|=|\eta Vi+(1-\eta)Vf|<0.000001774799\times f\times n/r2(V)$$

and preferably, $$|Vf+\eta VL|=|\eta Vi+(1-\eta)Vf|<9.870414\times10^{-13}\times f\times n/r2(V)$$

and the optimal value should become:

$$Vf+\eta VL=\eta Vi+(1-\eta)Vf=0$$

With regard to far magnetic field coefficient η, magnetic dipole moment strength m2 equivalent to when a current of strength I2 is caused to flow in a canceling exciting coil 30 unit with equivalent circular loop radius r2 and number of turns n is expressed by m2=μ×π×r2$^2$×n×I2, and the induction increase of self-inductance L0 of a canceling exciting coil 30 unit to self-inductance L1 when mounted in a shielding apparatus can be found from the following equation, assuming an increase as all far magnetic field components.

$$\eta=\frac{(2L0-2L1+\mu\pi nr2)L1}{2L0^2}$$

Figure 6:
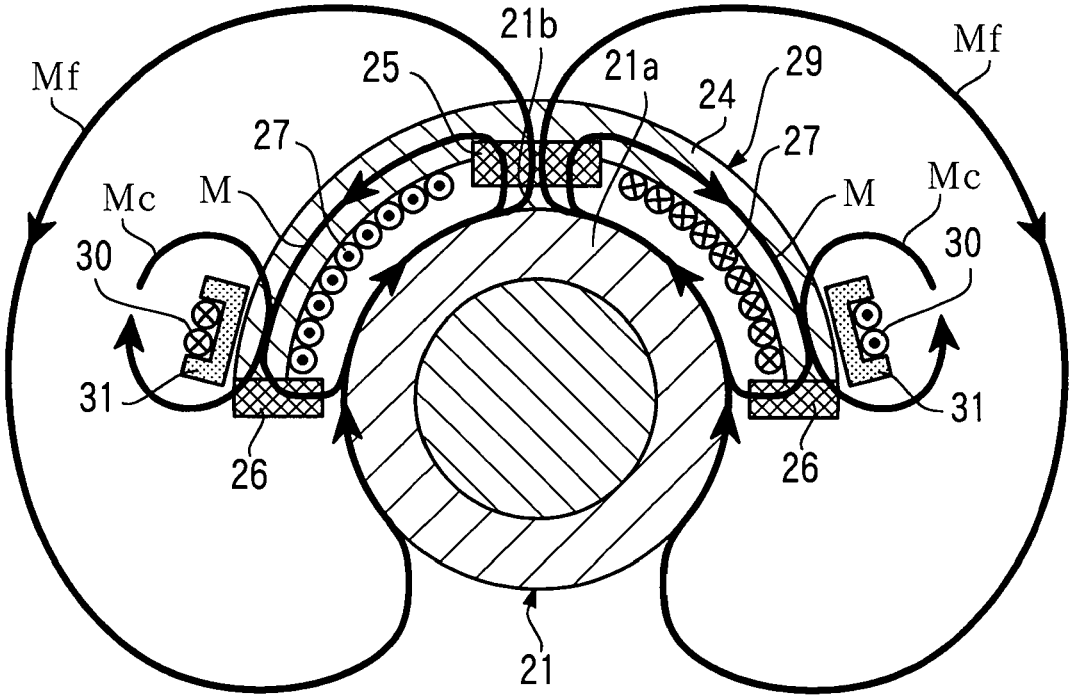
FIG. 6 is a schematic explanatory drawing for explaining the relationship between main flux and leakage flux and canceling flux of a shielding apparatus in which the fixing apparatus in FIG. 2 is applied.

Furthermore, as shown in FIG. 6, canceling exciting coil 30 is installed via coil supporting member 31 in a position where canceling flux Mc overlaps leakage flux Mf. Therefore, according to this shielding apparatus, canceling flux Mc and leakage flux Mf that have different directions and equal magnitude overlap, so that leakage flux Mf is canceled by canceling flux Mc, and leakage flux Mf can be effectively shielded.

Figure 7:
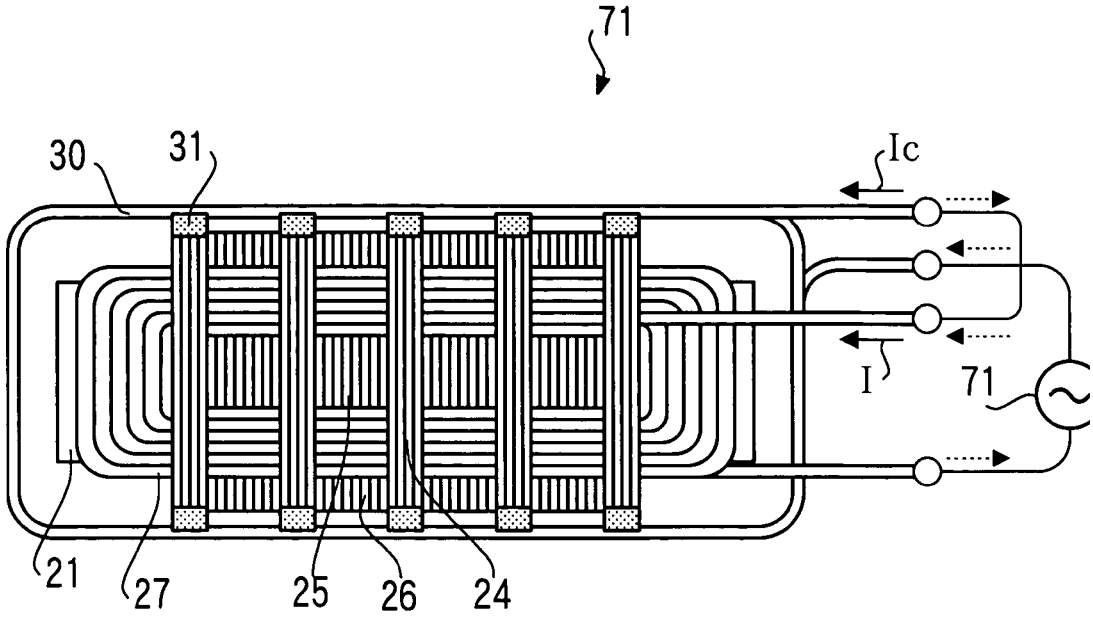
FIG. 7 is a schematic plan view of a shielding apparatus according to Embodiment 1.

FIG. 7 is a schematic plan view showing a shielding apparatus according to Embodiment 1 of the present invention. In this shielding apparatus 70 according to Embodiment 1, a magnetic field generation circuit that excites exciting coil 27 and a canceling magnetic field generation circuit that excites canceling exciting coil 30 form a closed circuit. Here, connections are made so that the current circulation directions are opposite for exciting coil 27 and canceling exciting coil 30. That is to say, as compared with the defined directions of main current I and canceling current Ic indicated by solid-line arrows in FIG. 7, the common current actually supplied from an exciting circuit 71 flows in opposite directions in exciting coil 27 and canceling exciting coil 30 as shown by the broken-line arrows in FIG. 7. In other words, as shown in FIG. 7, shielding apparatus 70 is configured so that exciting coil 27 and canceling exciting coil 30 are excited so that the directions of flux in the central parts of the coils become opposite by means of one exciting circuit 71.

According to this shielding apparatus 70 of Embodiment 1, by means of exciting circuit 71, canceling current Ic of the same magnitude as and opposite phase to main current I flowing in the magnetic field generation circuit of exciting coil 27 is caused to flow in the canceling magnetic field generation circuit of canceling exciting coil 30, and canceling flux Mc is generated. As leakage flux Mf leaking from main flux M and canceling flux Mc have a predetermined proportional relationship, it is possible to easily generate canceling flux Mc of a magnitude in accordance with leakage flux Mf by adjusting the magnitude of canceling flux Mc by changing the number of turns n, coil inner area, and winding distribution of canceling exciting coil 30. Specifically, if the number of turns n, coil inner area, and winding distribution of canceling exciting coil 30 are adjusted so that, using coefficient of coupling k1 between exciting coil 27 and canceling exciting coil 30 and self-inductance LL of exciting coil 27, self-inductance L1 of canceling exciting coil 30 satisfies the equation $L1=k1\times k1\times LL$, when mutual induction between heating element layer 21*b* and the canceling exciting coil can be ignored, canceling exciting coil 30 self-induced electromotive force VL and mutually induced electromotive force Vf are equal, and therefore the total flux passing through canceling exciting coil 30 can be made 0 or minimal. Also, if the number of turns n, coil inner area, and winding distribution of canceling exciting coil 30 are adjusted so that, using far magnetic field coefficient $\eta$ of canceling exciting coil 30, $L1=k1\times k1\times LL/(\eta\times\eta)$, when mutual induction between heating element layer 21*b* and the canceling exciting coil can be ignored, a far magnetic field component passing through canceling exciting coil 30 can be made 0 or minimal.

Embodiment 2

Figure 8:
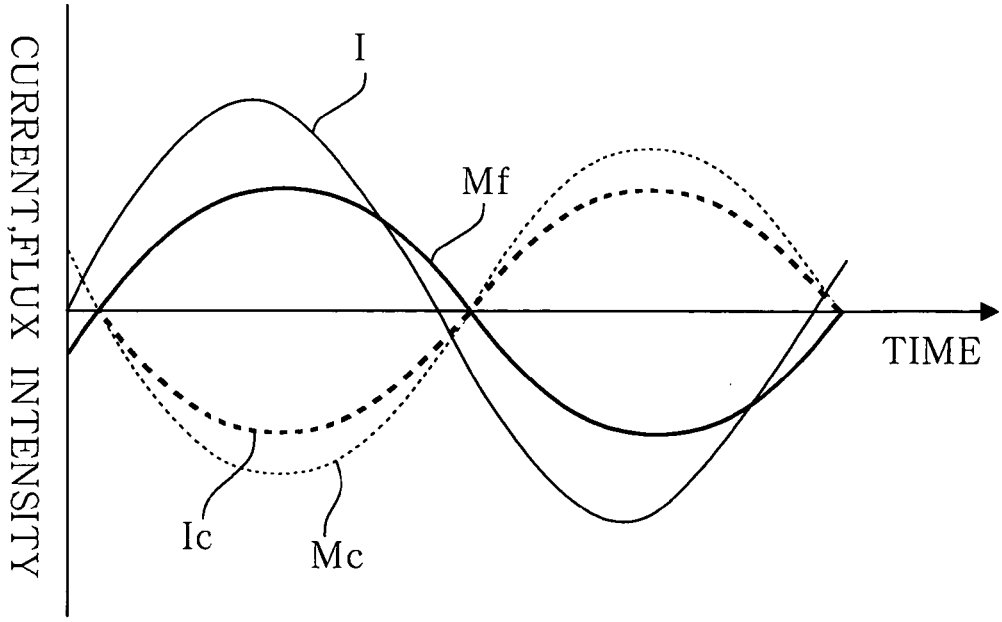
FIG. 8 is a graph showing the relationship between the main current flowing in the exciting coil of a shielding apparatus according to Embodiment 1 or Embodiment 2 and the canceling current flowing in the canceling exciting coil, and the relationship between leakage flux and canceling flux.

As shown in FIG. 8, for example, leakage flux Mf leaking from main flux M is generated at slightly later timing than the phase of main current I of exciting coil 27 that generates main flux M. The phase delay of leakage flux Mf increases, in particular, when the magnetic hysteresis of the material of the leakage flux Mf magnetic circuit cannot be ignored, or when the mutual induction between heating element layer 21*b* and canceling exciting coil 30 cannot be ignored. Therefore, to generate canceling flux Mc that can effectively cancel leakage flux Mf, it is desirable to shift the phase of canceling current Ic of canceling exciting coil 30 even further than the opposite phase of main current I.

Figure 9:
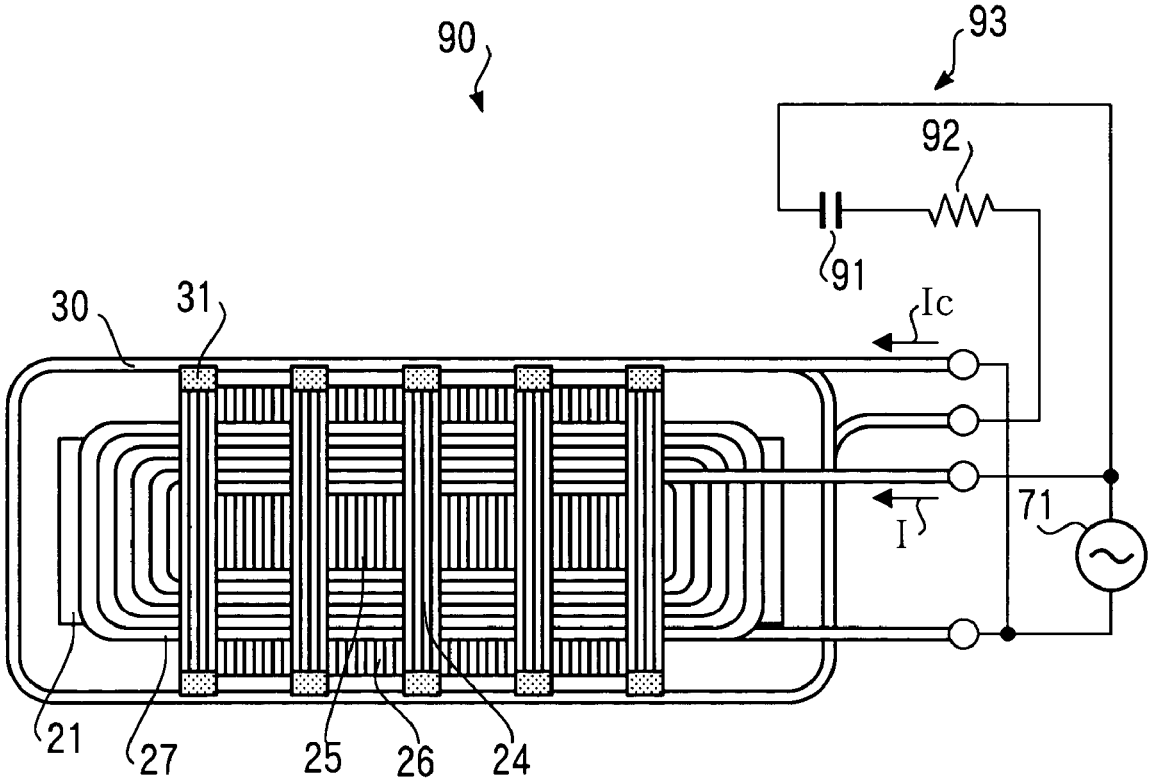
FIG. 9 is a schematic plan view of a shielding apparatus according to Embodiment 2.

FIG. 9 is a schematic plan view showing the configuration of a shielding apparatus according to Embodiment 2 of the present invention. As shown in FIG. 9, this shielding apparatus 90 is provided with a capacitor 91 and resistance 92 as a phase correction circuit that adjusts the phase of canceling current Ic flowing in canceling exciting coil 30 with respect to the phase of main current I flowing in exciting coil 27, and exciting coil 27, canceling magnetic field generation circuit 93 comprising a series circuit incorporating canceling exciting coil 30, capacitor 91, and resistance 92, and exciting coil 27 are connected in parallel to common exciting circuit 71. If left winding is defined as positive for the coil turn direction in FIG. 9, the exciting coil 27 turn terminating end and canceling exciting coil 30 turn starting end are connected to the same terminal of exciting circuit 71.

According to shielding apparatus 90 of Embodiment 2 of the present invention, the same alternating voltage is supplied to exciting coil 27 and canceling magnetic field generation circuit 93 from common exciting circuit 71, but current flows in accordance with the respective impedances. The real part of the impedance of canceling magnetic field generation circuit 93 can be adjusted by changing the size of resistance 92, and the imaginary part can be adjusted by changing the number of turns n, coil inner area, and winding distribution of canceling exciting coil 30, and the capacitance of capacitor 91.

Thus, the phase angle of the impedance of canceling magnetic field generation circuit 93 becomes the same as the phase angle resulting from adding the phase delay between main current I and leakage flux Mf to the phase angle of the impedance of exciting coil 27, and the real part and imaginary part of the impedance of canceling magnetic field generation circuit 93 are adjusted so that leakage flux Mf and canceling flux Mc are balanced. By this means, the phase of canceling current Ic flowing in canceling exciting coil 30 is corrected so as to be later than the opposite phase to the phase of main current I flowing in exciting coil 27.

As a result, it becomes possible to make the phases of leakage flux Mf leaking from main flux M and canceling flux Mc coincide, as shown in FIG. 8, and leakage flux Mf can be canceled effectively by canceling flux Mc or a far magnetic field component of canceling flux Mc. If the value of the imaginary part of the optimal impedance of canceling magnetic field generation circuit 93 can be implemented by adjusting the number of turns n, coil inner area, and winding distribution of canceling exciting coil 30, capacitor 91 may be eliminated.

Embodiment 3

Exciting coil 27 and canceling exciting coil 30 are not the same in terms of electrical circuit characteristics. With regard to impedance characteristics when the frequency changes, in particular, there is a great difference in the manner in which change occurs. Therefore, although the above-described method whereby a common current is caused to flow in exciting coil 27 and canceling exciting coil 30 of shielding apparatus 70 according to Embodiment 1, or the method whereby a common voltage is applied to canceling magnetic field generation circuit 93 including exciting coil 27 and canceling exciting coil 30 of shielding apparatus 90 according to Embodiment 2, can effectively shield leakage flux Mf for a sinusoidal main current I of a specific drive frequency, when the main current I drive current varies or when a main current I of an arbitrary current waveform is caused to flow in exciting coil 27, it becomes difficult to effectively shield leakage flux Mf. Shielding apparatuses according to the embodiments below solve this problem.

Figure 10:
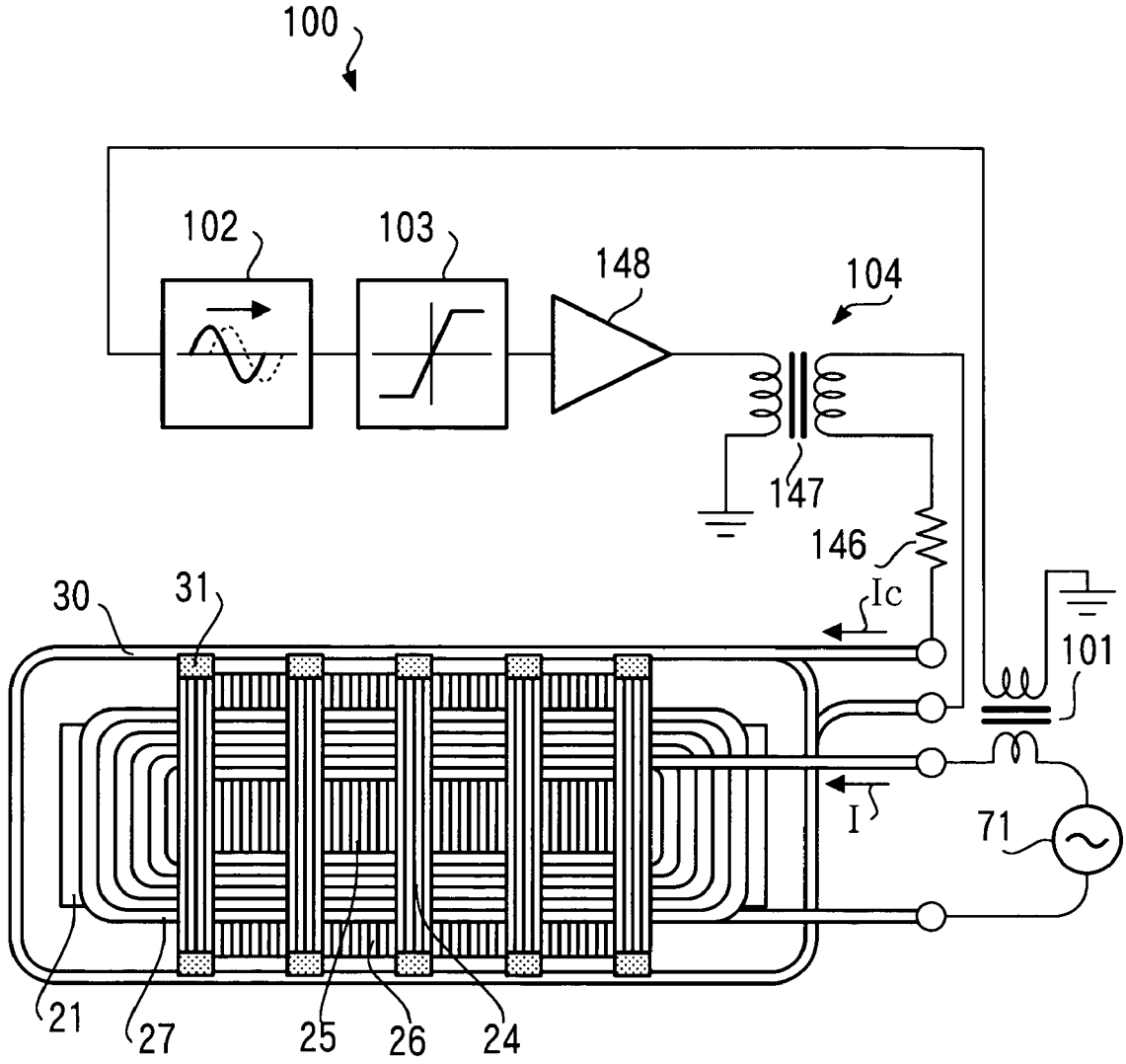
FIG. 10 is a schematic plan view of a shielding apparatus according to Embodiment 3.

FIG. 10 is a schematic plan view showing the configuration of a shielding apparatus according to Embodiment 3 of the present invention. As shown in FIG. 10, this shielding apparatus 100 is provided with a current transformer 101 as an exciting coil current detection section that detects main current I passed through exciting coil 27 by exciting circuit 71.

This shielding apparatus 100 is also provided with a current processing circuit that processes canceling current Ic flowing in canceling exciting coil 30 in accordance with the current detected by current transformer 101.

This current processing circuit of shielding apparatus 100 is composed of a phase control circuit 102, an amplitude control circuit 103, and a canceling exciting coil drive amplifier 104 as an amplification circuit. Phase control circuit 102 controls the phase of canceling current Ic flowing in canceling exciting coil 30. Specifically, control is performed so that the phase of the input signal waveform of canceling exciting coil drive amplifier 104 becomes a predetermined value according to the frequency of the current waveform detected by current transformer 101. Amplitude control circuit 103 controls the amplitude of canceling current Ic flowing in canceling exciting coil 30.

Specifically, the amplitude of the input signal waveform of canceling exciting coil drive amplifier 104 is controlled so that the amplitude multiplying factor of main current I and canceling current Ic becomes a predetermined value according to the frequency of the current waveform detected by current transformer 101. Canceling exciting coil drive amplifier 104 is provided with a power amplification circuit 148, a matching transformer 147 for isolation and impedance matching, and a protective resistance 146, and supplies power for causing the flow of canceling current Ic that flows in canceling exciting coil 30. In FIG. 10, only the main grounding points are shown, and internal grounding points, etc., for exciting circuit 71, phase control circuit 102, amplitude control circuit 103, and power amplification circuit 148 are omitted.

According to this shielding apparatus 100 of Embodiment 3, canceling current Ic flowing in canceling exciting coil 30 can be processed by the above-described current processing circuit according to the current detected by current transformer 101 so that leakage flux Mf and canceling flux Mc or a far magnetic field component of canceling flux Mc become equal. Also, in this shielding apparatus 100, when a main current I of an arbitrary current waveform is caused to flow in exciting coil 27, the phase difference and amplitude ratio between main current I and canceling current Ic can be set to predetermined values for each frequency component of main current I. By this means, leakage flux Mf leaking from main flux M can be canceled more effectively by means of canceling flux Mc or a far magnetic field component of canceling flux Mc.

In this shielding apparatus 100, when leakage flux Mf is canceled by canceling flux Mc through the operation of canceling exciting coil 30, the inter-terminal voltage of canceling exciting coil 30 becomes almost 0, and the apparent impedance becomes small. If power amplification circuit 148 can supply a predetermined canceling current Ic in this state, matching transformer 147 and error detection circuit 146 may be eliminated. Also, if the phase difference of the current and voltage supplied by power amplification circuit 148 is large, a capacitor can be inserted in series with error detection circuit 146 to improve the power factor.

Embodiment 4

Figure 11:
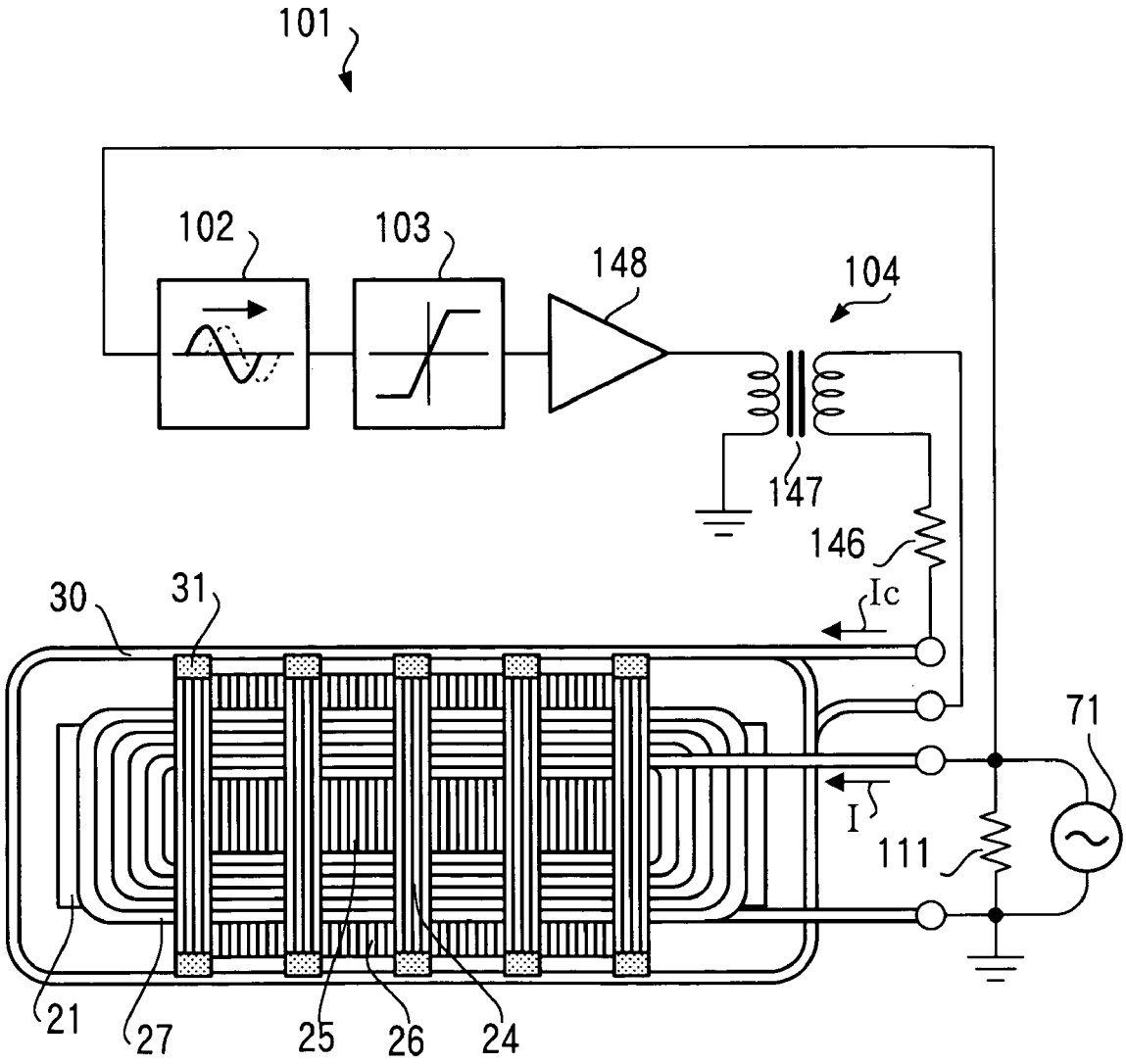
FIG. 11 is a schematic plan view of a shielding apparatus according to Embodiment 4.

FIG. 11 is a schematic plan view showing the configuration of a shielding apparatus according to Embodiment 4 of the present invention. As shown in FIG. 11, this shielding apparatus 110 is provided with an exciting coil voltage detection resistance 111 as an exciting coil voltage detection circuit that detects the voltage supplied to exciting coil 27 by exciting circuit 71.

This shielding apparatus 100 is also provided with a current processing circuit that processes canceling current Ic flowing in canceling exciting coil 30 in accordance with the voltage detected by exciting coil voltage detection resistance 111. As with the current processing circuit of shielding apparatus 100 according to Embodiment 3 of the present invention, this current processing circuit of shielding apparatus 110 is provided with a phase control circuit 102, amplitude control circuit 103, and canceling exciting coil drive amplifier 104. Canceling exciting coil drive amplifier 104 is provided with a power amplification circuit 148, matching transformer 147, and protective resistance 146. In FIG. 11, only the main grounding points are shown, and internal grounding points, etc., for exciting circuit 71, phase control circuit 102, amplitude control circuit 103, and power amplification circuit 148 are omitted.

According to this shielding apparatus 110 of Embodiment 4, canceling current Ic flowing in canceling exciting coil 30 can be processed by the above-described current processing circuit according to the current detected by exciting coil voltage detection resistance 111 so that leakage flux Mf and canceling flux Mc or a far magnetic field component of canceling flux Mc become equal. By this means, leakage flux Mf leaking from main flux M can be canceled more effectively by means of canceling flux Mc or a far magnetic field component of canceling flux Mc.

Embodiment 5

Figure 12:
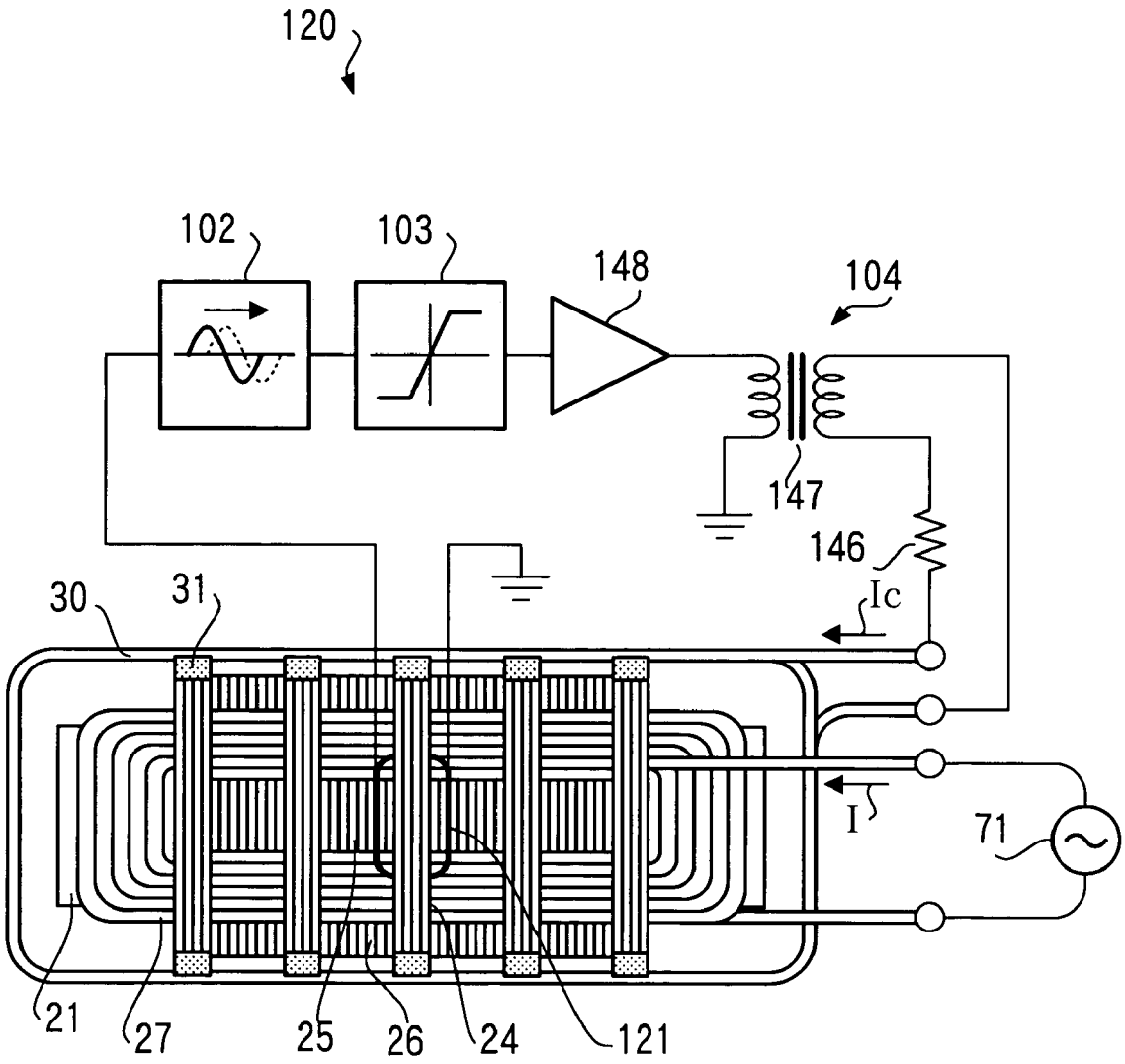
FIG. 12 is a schematic plan view of a shielding apparatus according to Embodiment 5.
Figure 13:
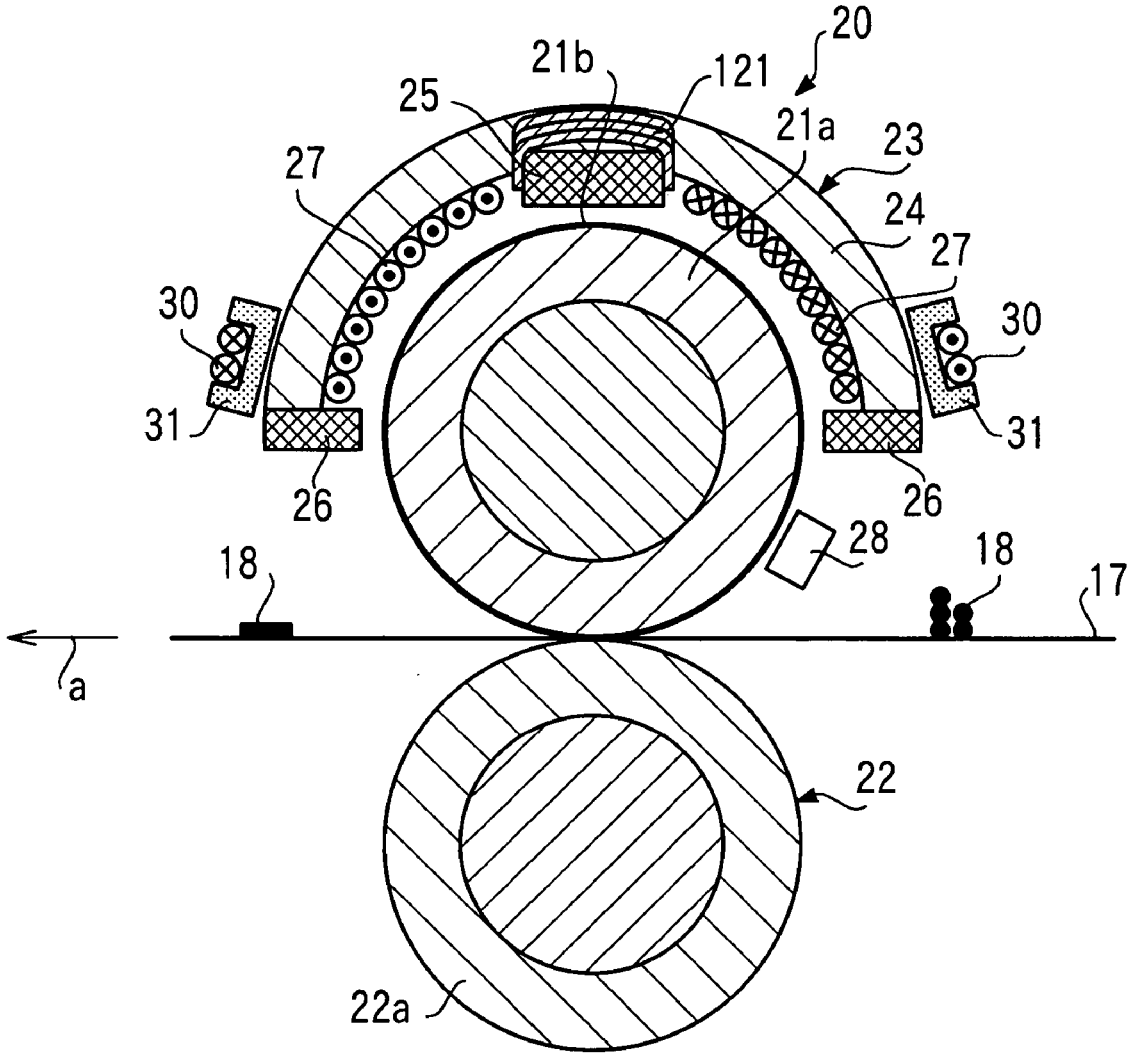
FIG. 13 is a schematic cross-sectional drawing of a shielding apparatus according to Embodiment 5.

FIG. 12 is a schematic plan view showing the configuration of a shielding apparatus according to Embodiment 5 of the present invention. FIG. 13 is a cross-sectional diagram showing the configuration of a shielding apparatus according to Embodiment 5 of the present invention. As shown in FIG. 12 and FIG. 13, a shielding apparatus 120 according to Embodiment 5 of the present invention is provided with a flux detection coil 121 as a flux detection means that detects alternating flux generated in a magnetic field generation circuit composed of an exciting circuit 71 and exciting coil 27. As shown in FIG. 12 and FIG. 13, this flux detection coil 121 is located so as to encircle the point of intersection of arch core 24 and center core 25.

This shielding apparatus 120 is also provided with a current processing circuit that processes canceling current Ic flowing in canceling exciting coil 30 in accordance with the flux detected by flux detection coil 121. As with the current processing circuit of shielding apparatus 100 according to Embodiment 3 of the present invention, this current processing circuit of shielding apparatus 120 is provided with a phase control circuit 102, amplitude control circuit 103, and canceling exciting coil drive amplifier 104. Canceling exciting coil drive amplifier 104 is provided with a power amplification circuit 148, matching transformer 147, and protective resistance 146. In FIG. 12, only the main grounding points are shown, and internal grounding points, etc., for exciting circuit 71, phase control circuit 102, amplitude control circuit 103, and power amplification circuit 148 are omitted.

According to this shielding apparatus 120 of Embodiment 5, canceling current Ic flowing in canceling exciting coil 30 can be processed by the above-described current processing circuit according to flux detected by flux detection coil 121 so that leakage flux Mf and canceling flux Mc or a far magnetic field component of canceling flux Mc become equal. By this means, leakage flux Mf leaking from main flux M can be canceled more effectively by means of canceling flux Mc or a far magnetic field component of canceling flux Mc.

Embodiment 6

Figure 14:
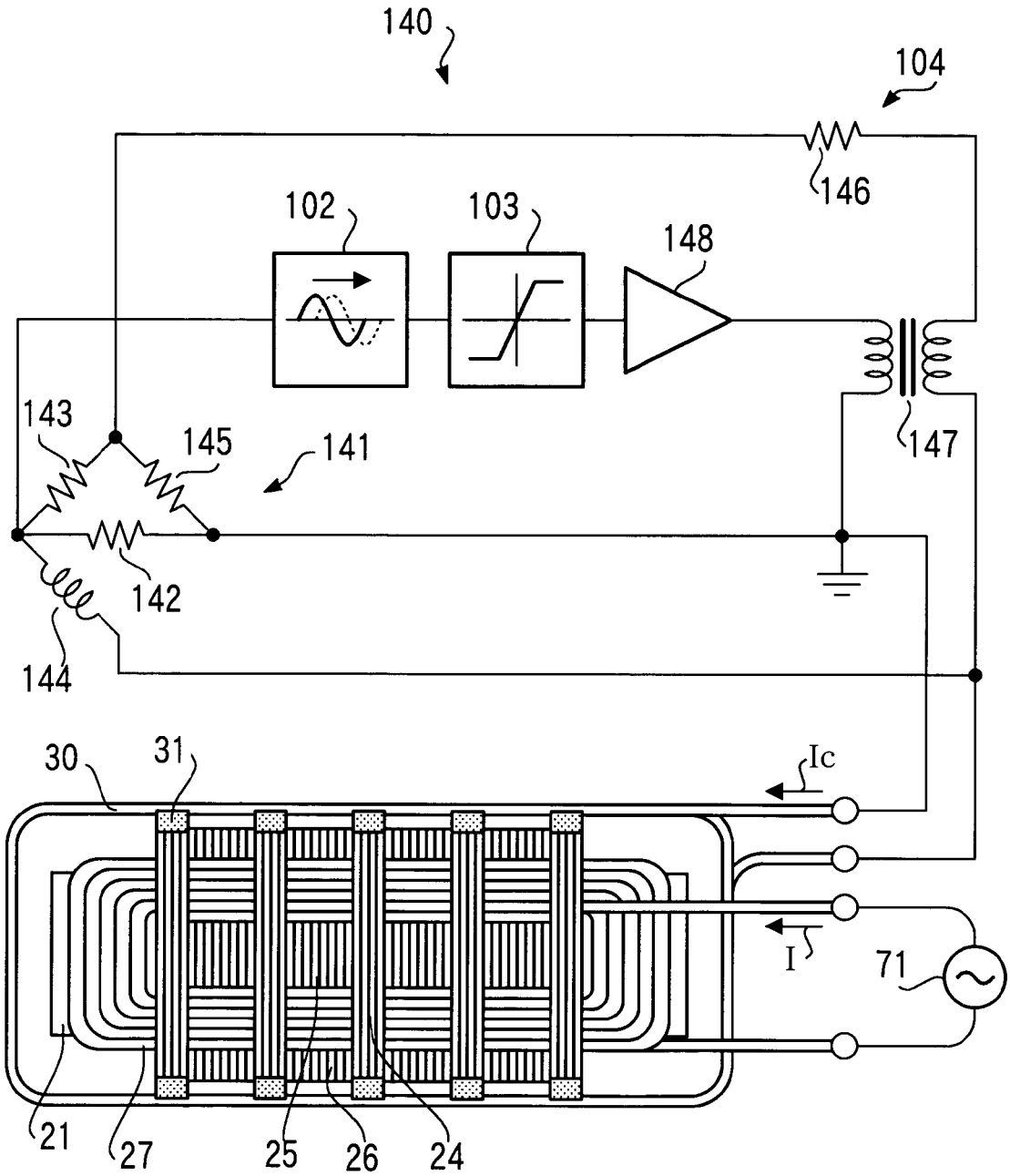
FIG. 14 is a schematic plan view of a shielding apparatus according to Embodiment 6.

FIG. 14 is a schematic plan view showing the configuration of a shielding apparatus according to Embodiment 6 of the present invention. As shown in FIG. 14, a shielding apparatus 140 according to Embodiment 6 of the present invention is provided with a mutually induced electromotive force detection circuit that detects mutually induced electromotive force induced in canceling exciting coil 30 itself. The mutually induced electromotive force detection circuit is configured with a mutually induced electromotive force detection resistance 142 located in a bridge circuit 141 that includes canceling exciting coil 30.

In this bridge circuit 141, a resistor 145 of impedance Z1 is located adjacent to canceling exciting coil 30, an inductor 144 of impedance Z2 is located on the opposite side of canceling exciting coil 30, and a resistor 143 of impedance Z3 is located opposite canceling exciting coil 30, and the resistance values of resistor 145 and resistor 143 are adjusted so that, taking the impedance of canceling exciting coil 30 as L1, the impedance size relationship is $L1 \times Z3 = Z1 \times Z2$. Also, for resistor 145 and resistor 143, the impedance relationship is $Z3 > Z1$ in order to reduce the current passing around canceling exciting coil 30. Mutually induced electromotive force detection resistance 142 detects the potential difference between the point of connection between canceling exciting coil 30 and resistor 145 and the point of connection between inductor 144 and resistor 143.

As with the current processing circuit of shielding apparatus 100 according to Embodiment 3 of the present invention, the current processing circuit of shielding apparatus 140 is provided with a phase control circuit 102, amplitude control circuit 103, and canceling exciting coil drive amplifier 104. Canceling exciting coil drive amplifier 104 is provided with a power amplification circuit 148, matching transformer 147, and protective resistance 146. In FIG. 14, only the main grounding points are shown, and internal grounding points, etc., for exciting circuit 71, phase control circuit 102, amplitude control circuit 103, and power amplification circuit 148 are omitted.

The above-described mutually induced electromotive force detection circuit operates as follows. In FIG. 14, on the canceling exciting coil 30 and resistor 145 side of bridge circuit 141, canceling current Ic is supplied from canceling exciting coil drive amplifier 104, and therefore a voltage is generated in canceling exciting coil 30 that is the result of adding self-induced electromotive force VL generated through the self-induction effect of canceling current Ic to mutually induced electromotive force Vf generated through the effect of mutual induction with leakage flux Mf passing through canceling exciting coil 30.

Meanwhile, on the resistor 143 and inductor 144 side of bridge circuit 141, a current proportional to canceling current Ic flows due to the impedance relationships of bridge circuit 141, and therefore a voltage that is the same as self-induced electromotive force VL generated in canceling exciting coil 30 through the self-induction effect of canceling current Ic is generated at the point of connection of resistor 143 and inductor 144. Therefore, by detecting the potential difference between the point of connection of canceling exciting coil 30 and resistor 145 and the point of connection of inductor 144 and resistor 143 using mutually induced electromotive force detection resistance 142, it is possible to extract only mutually induced electromotive force Vf induced in canceling exciting coil 30 itself without being affected by canceling current Ic.

Impedance adjustment can be further simplified by using variable resistors for resistor 143 and resistor 145 of bridge circuit 141. Also, the heat generation of bridge circuit 141 can be reduced by using inductors or capacitors instead of resistor 143 and resistor 145. Moreover, an improvement in the power factor of bridge circuit 141 can be expected if capacitors are used.

According to this shielding apparatus 140 of Embodiment 6, canceling current Ic flowing in canceling exciting coil 30 can be processed by the above-described current processing circuit according to mutually induced electromotive force Vf induced in canceling exciting coil 30 itself, extracted by mutually induced electromotive force detection resistance 142 of bridge circuit 141, so that leakage flux Mf and canceling flux Mc or a far magnetic field component of canceling flux Mc become equal. By this means, leakage flux Mf leaking from main flux M can be canceled more effectively by means of canceling flux Mc or a far magnetic field component of canceling flux Mc.

Embodiment 7

Figure 15:
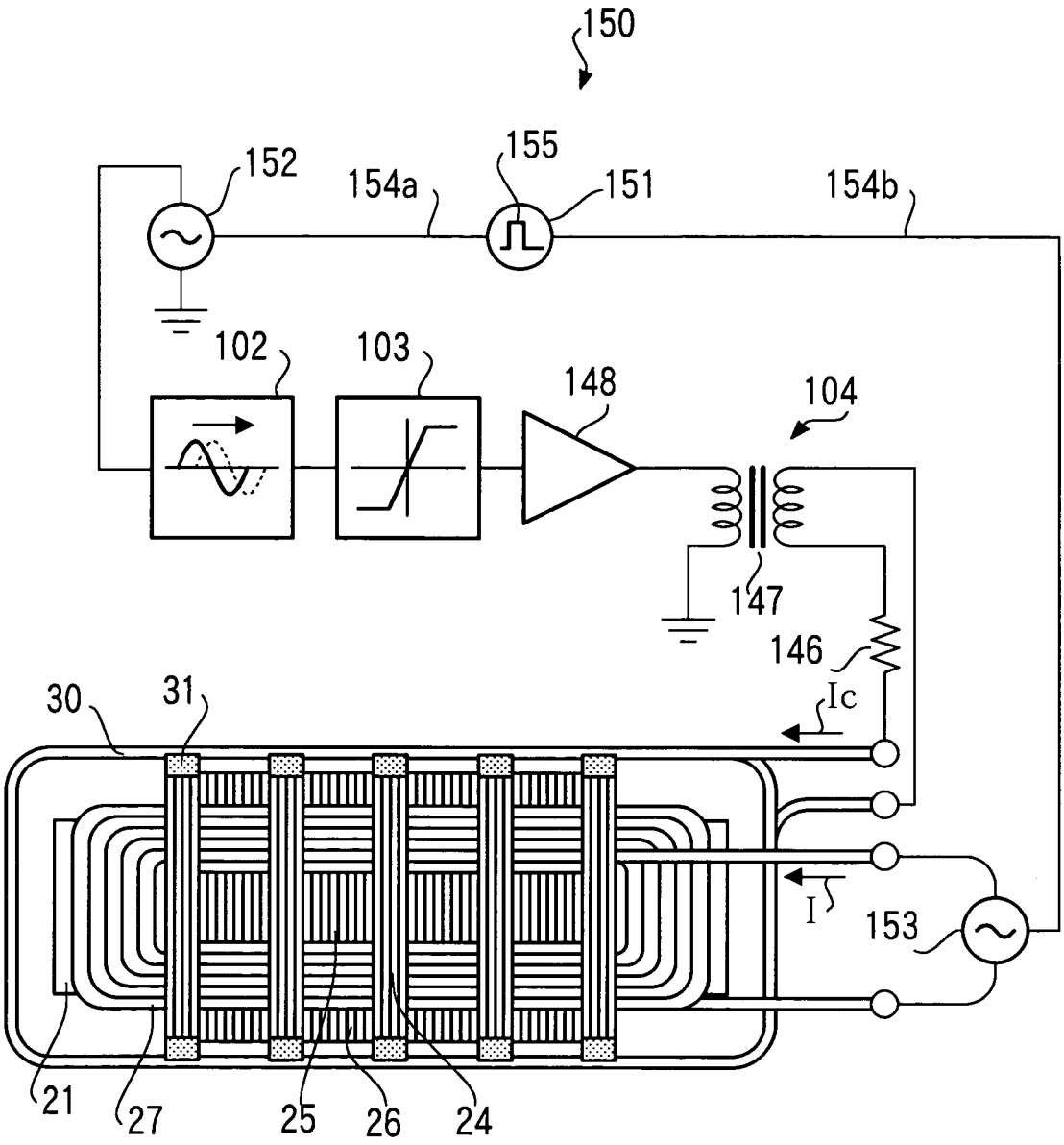
FIG. 15 is a schematic plan view of a shielding apparatus according to Embodiment 7.

FIG. 15 is a schematic plan view showing the configuration of a shielding apparatus according to Embodiment 7 of the present invention. As shown in FIG. 15, a shielding apparatus 150 according to Embodiment 7 of the present invention is provided with a synchronization signal generation circuit 151 that generates a synchronization signal 155 synchronized by main current I flowing through a magnetic field generation circuit composed of an exciting circuit 153 and exciting coil 27, exciting circuit 153 that generates main current I synchronized with synchronization signal 155, and a canceling exciting coil drive signal generation circuit 152 that generates a drive signal that drives canceling exciting coil 30 based on synchronization signal 155. Synchronization signal generation circuit 151 and exciting circuit 153 are electrically connected by synchronization signal transfer circuit 154*a*, and synchronization signal generation circuit 151 and canceling exciting coil drive signal generation circuit 152 are electrically connected by synchronization signal transfer circuit 154*b*.

This shielding apparatus 150 is also provided with a current processing circuit that processes canceling current Ic flowing in canceling exciting coil 30 in accordance with a drive signal output by canceling exciting coil drive signal generation circuit 152. As with the current processing circuit of shielding apparatus 100 according to Embodiment 3 of the present invention, the current processing circuit of shielding apparatus 150 is provided with a phase control circuit 102, amplitude control circuit 103, and canceling exciting coil drive amplifier 104. Canceling exciting coil drive amplifier 104 is provided with a power amplification circuit 148, matching transformer 147, and protective resistance 146. In FIG. 15, only the main grounding points are shown, and internal grounding points, etc., for exciting circuit 153, synchronization signal generation circuit 151, canceling exciting coil drive signal generation circuit 152, phase control circuit 102, amplitude control circuit 103, and power amplification circuit 148 are omitted. A non-electrical means may be used for synchronization signal transfer circuits 154, such as an optical transmission method employing optical cable or photocouplers, or a magnetic means such as a transformer.

According to this shielding apparatus 150 of Embodiment 7, canceling current Ic flowing in canceling exciting coil 30 can be processed by the above-described current processing circuit according to a drive signal output by canceling exciting coil drive signal generation circuit 152 so that leakage flux Mf and canceling flux Mc or a far magnetic field component of canceling flux Mc become equal. By this means, leakage flux Mf leaking from main flux M can be canceled more effectively by means of canceling flux Mc or a far magnetic field component of canceling flux Mc.

Embodiment 8

It is possible that the state of the above-described magnetic circuit and the circuit constants of the above-described magnetic field generation circuit and the above-described canceling magnetic field generation circuit may change with the passage of time due to temperature changes, secular change, and so forth. Thus, a case can also be envisaged in which a state in which leakage flux Mf leaking from main flux M is effectively canceled by canceling flux Mc can no longer be maintained. It is therefore desirable for adjustment to be carried out through constant control of the phase and amplitude of canceling current Ic of canceling exciting coil 30 to enable generation of canceling flux Mc that is always capable of effectively canceling leakage flux Mf.

Figure 16:
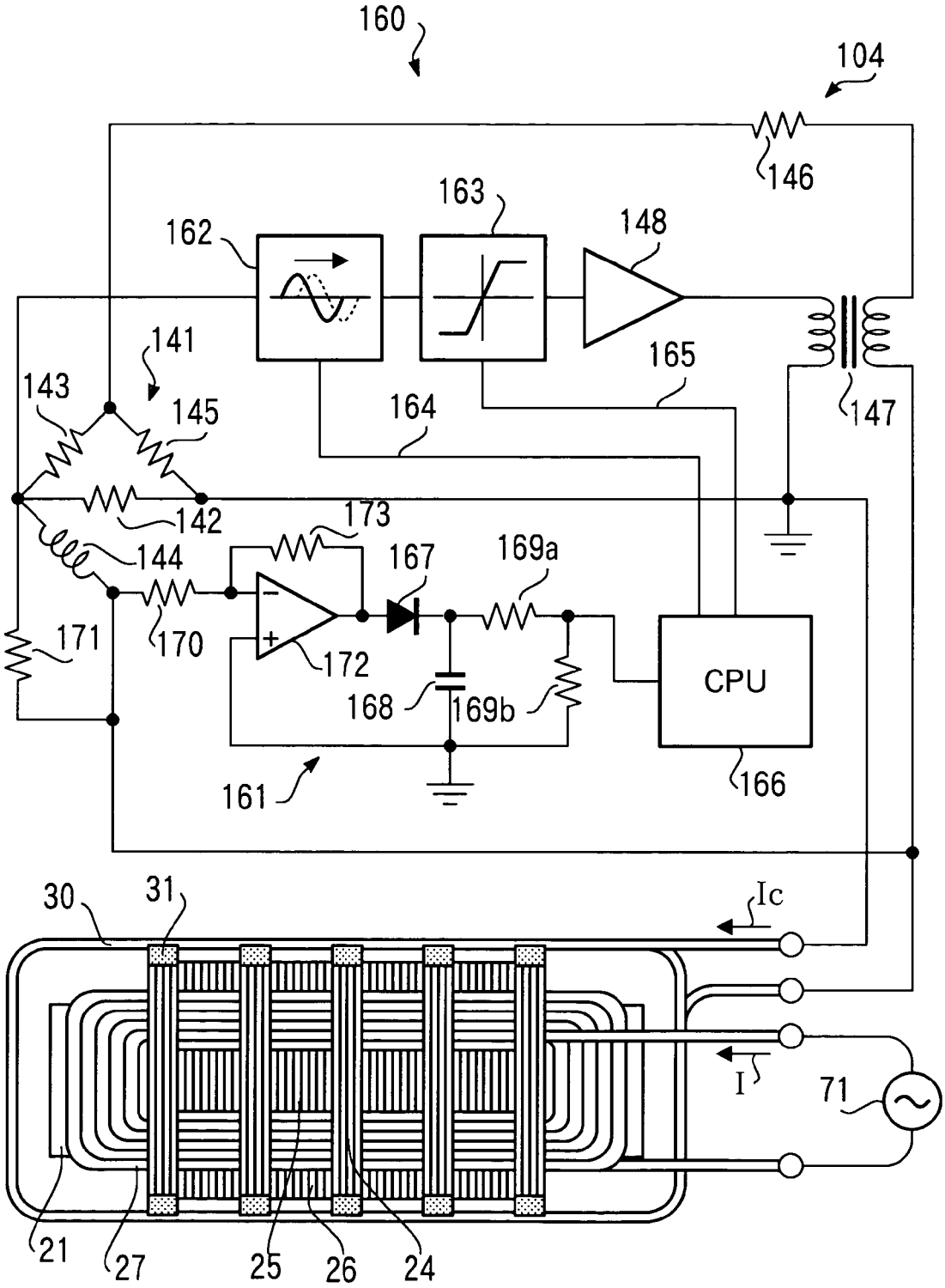
FIG. 16 is a schematic plan view of a shielding apparatus according to Embodiment 8.

FIG. 16 is a schematic plan view showing the configuration of a shielding apparatus according to Embodiment 8 of the present invention. A shielding apparatus according to Embodiment 8 differs from shielding apparatus 140 according to Embodiment 6 in the configuration of the current processing circuit. As shown in FIG. 16, this shielding apparatus 160 is provided with a canceling exciting coil voltage detection circuit 161 and a control signal computation apparatus 166.

Canceling exciting coil voltage detection circuit 161 converts the voltage at either end of canceling exciting coil 30 to a DC voltage as a leakage flux control voltage, and detects this voltage. Control signal computation apparatus 166 generates a phase control signal and amplitude control signal for controlling the phase and amplitude of canceling current Ic based on the aforementioned leakage flux control voltage, and outputs these signals to a phase control signal transfer circuit 164 and amplitude control signal transfer circuit 165, respectively. A phase control circuit 162 controls the phase of canceling current Ic flowing in canceling exciting coil 30 based on a phase control signal transferred from phase control signal transfer circuit 164. An amplitude control circuit 163 controls the amplitude of canceling current Ic flowing in canceling exciting coil 30 based on an amplitude control signal transferred from amplitude control signal transfer circuit 165. The remaining configuration is the same as the configuration of shielding apparatus 140 according to Embodiment 6, and therefore a detailed description of identical configuration elements will be omitted, and only points of difference from the configuration of shielding apparatus 140 will be described.

Canceling exciting coil voltage detection circuit 161 is provided with an op-amp 172, a canceling exciting coil voltage detection resistance 170 that is the input resistance of op-amp 172, a feedback resistance 173 that defines the alternating current amplification factor of op-amp 172, a commutator 167 that converts an AC voltage to a DC pulsating current, a smoothing capacitor 168 that smoothes the aforementioned DC pulsating current, and voltage-dividing resistances 169*a* and 169*b* for sensitivity adjustment.

Resistance value R of canceling exciting coil voltage detection resistance 170 is made sufficiently large compared with the inductance of canceling exciting coil 30 to avoid affecting the balance of bridge circuit 141. Also, a balance resistance 171 is inserted in parallel with inductor 144, and with regard to the impedance balance of bridge circuit 141, taking the impedance of the parallel circuit comprising inductor 144 and balance resistance 171 as Z22, and the impedance of the parallel circuit comprising canceling exciting coil 30 and canceling exciting coil voltage detection resistance 170 as Z11, the resistance values of resistor 145, resistor 143, canceling exciting coil voltage detection resistance 170, and balance resistance 171 are adjusted so that L11×Z3=Z1×Z22.

The aforementioned leakage flux control voltage is generated by having the alternating voltage at either end of canceling exciting coil 30 detected by canceling exciting coil voltage detection resistance 170 amplified by op-amp 172, converted to a DC voltage using commutator 167 and smoothing capacitor 168, and divided into a predetermined voltage by voltage-dividing resistances 169*a* and 169*b*.

Control signal computation apparatus 166 has the above-described leakage flux control voltage as input, and outputs a phase control signal and amplitude control signal. In control signal computation apparatus 166, a control table stored in a storage apparatus (not shown) and an input leakage flux control voltage value undergo a comparison operation based on a control algorithm stored in a storage apparatus (not shown), and the phase control signal and amplitude control signal are constantly varied so that the leakage flux control voltage approaches 0.

As the control algorithm, a method can be used, for example, whereby the phase value or amplitude value of canceling current Ic is first forcibly increased and decreased in a certain infinitesimal range, the amount of change of the leakage flux control voltage at that time is compared for the increase case and decrease case, and the central phase value or amplitude value of canceling current Ic is shifted in the direction in which the leakage flux control voltage approaches 0.

As target control values, to make the magnetic field strength less than 2.65 μN/Am at a distance of 30 M from the center of canceling exciting coil 30, if the alternating voltage of the component eliminated by a complex vector operation on voltage Vr due to the DC resistance component of canceling exciting coil 30 from AC voltage Va of both ends of canceling exciting coil 30 is designated Vi, the alternation frequency of the aforementioned canceling current is designated f, the number of turns of canceling exciting coil 30 is designated n, and the equivalent circular loop radius of canceling exciting coil 30 is designated r2, then the following should be used:

$$|Vi|<0.000001774799\times f\times n/r2$$

Preferably, if $$|Vi|<9.870414\times10^{-13}\times f\times n/r2(V)$$

is used, the magnetic field strength at a point 0.2 m from the center of canceling exciting coil 30 can be made less than 4.974 μN/Am. If voltage Vr due to the DC resistance component of canceling exciting coil 30 is made sufficiently small with respect to the Vi reference value, the relationship Vi=Va is acceptable. As an optimal value, if Vi=0, the total flux passing through canceling exciting coil 30 is made 0.

When only a magnetic field generated at a distance is to be canceled, shielding apparatus 160 is further provided with an induced electromotive force detection circuit equivalent to canceling exciting coil voltage detection circuit 161, the potential of the point of connection of inductor 144 and resistor 143 is detected as mutually induced electromotive force Vf, and is sent to control signal computation apparatus 166. Control signal computation apparatus 166 produces a phase control signal and amplitude control signal so that, using canceling exciting coil 30 far magnetic field coefficient η, the sum of mutually induced electromotive force Vf and the product of self-induced electromotive force VL generated by canceling current Ic and η is less than a predetermined value. That is to say, ideally, $$|Vf+\eta VL|=|\eta Vi+(1-\eta)Vf|<0.000001774799\times f\times n/r2(V)$$

and preferably, $$|Vf+\eta VL|=|\eta Vi+(1-\eta)Vf|<9.870414\times10^{-13}\times f\times n/r2(V)$$

and the optimal value should be $$Vf+\eta VL=\eta Vi+(1-\eta)Vf=0.$$

In the ideal state, Vi and Vf are voltages of virtually opposite phases, and therefore control signal computation apparatus 166 performs control so that the relationship between Vi and Vf, using the absolute values of each, is ideally $$\eta|Vi|-(1-\eta)|Vf|<0.000001774799\times f\times n/r2(V)$$

and preferably $$\eta|Vi|-(1-\eta)|Vf|<9.870414\times10^{-13}\times f\times n/r2(V)$$

and the optimal value becomes $$\eta|Vi|-(1-\eta)|Vf|=0.$$

According to this shielding apparatus 160 of Embodiment 8, canceling current Ic flowing in canceling exciting coil 30 can be processed by the above-described current processing circuit so that the leakage flux control voltage detected by canceling exciting coil voltage detection circuit 161 becomes 0 or minimal. By this means, leakage flux Mf passing through canceling exciting coil 30 and canceling flux Mc or a far magnetic field component of canceling flux Mc become equal, and therefore leakage flux Mf leaking from main flux M can be canceled more effectively by means of canceling flux Mc or a far magnetic field component of canceling flux Mc.

The aforementioned control algorithm is not limited to the method described for this shielding apparatus 160 according to Embodiment 8, and it is also possible to use an algorithm based on control theory such as classic control theory, modern control theory, fuzzy control, neuro-control, learning control, or robust control. Also, control signal computation apparatus 166 may use analog computation, digital computation, or both analog computation and digital computation, as a computation method.

In shielding apparatus 160 according to Embodiment 8, an example has been shown in which, in a shielding apparatus that generates canceling current Ic based on a mutually induced electromotive force induced in canceling exciting coil 30 itself using bridge circuit 141, canceling current Ic is processed so that the leakage flux control voltage detected by canceling exciting coil voltage detection circuit 161 becomes minimal (or zero), but this kind of canceling current Ic processing method is not limited to shielding apparatus 160.

For example, this kind of canceling current Ic processing method is also effective for any of the following shielding apparatuses: a shielding apparatus that generates canceling current Ic in accordance with a current detected by an exciting coil current detection circuit as illustrated by shielding apparatus 100 according to Embodiment 3, a shielding apparatus that generates canceling current Ic in accordance with a voltage detected by an exciting coil voltage detection circuit as illustrated by shielding apparatus 110 according to Embodiment 4, a shielding apparatus that generates canceling current Ic in accordance with flux detected by a flux detection circuit as illustrated by shielding apparatus 120 according to Embodiment 5, or a shielding apparatus that generates canceling current Ic in accordance with a synchronization signal synchronized with main current I as illustrated by shielding apparatus 150 according to Embodiment 7. As these shielding apparatuses do not have a bridge circuit 141, balance resistance 171 is not necessary when the above-described kind of canceling current Ic processing method is applied to these shielding apparatuses.

In FIG. 16, only the main grounding points are shown, and internal grounding points, etc., for control signal computation apparatus 166, phase control circuit 162, amplitude control circuit 163, and power amplification circuit 148 are omitted. Power supply circuitry for op-amp 172 and other active elements is also omitted. An optical transmission method employing optical cable and photocouplers, for example, or a magnetic means other than an electrical means such as a transformer, may be used for phase control signal transfer circuit 164 and amplitude control signal transfer circuit 165.

A shielding apparatus of the present invention is not limited to the above-described configurations, and can also be applied to a configuration in which magnetic circuit 29 includes a permanent magnet or a coil in which direct current flows, and alternating flux is generated by rotation or oscillation of the permanent magnet or coil in which direct current flows.

An induction heating apparatus of the present invention is not limited to the above-described configurations, and can also be applied to a case where exciting coil 27 is inside heating element layer 21*b*.

An induction heating apparatus of the present invention is not limited to the above-described configurations, and can also be applied to a case where exciting coil 27 is tubular in shape and has a heating element layer 21*b* inside the tube, or to a case where exciting coil 27 is a flat spiral in shape and has a heating element layer 21*b* on the opposite surface.

This application is based on the Japanese Patent Application No.2003-363887 filed on Oct. 23, 2003, entire content of which is expressly incorporated by reference herein.

What is claimed is:

1. A shielding apparatus that shields flux leakage from a magnetic circuit that has an exciting coil through which an excitation current passes and that generates alternating flux, the shielding apparatus comprising:

a canceling exciting coil that generates canceling flux for canceling the flux leakage by applying a canceling current corresponding to said alternating flux;

wherein said exciting coil and said canceling exciting coil are connected in series;

wherein the canceling current is an alternating current of a phase opposite to a phase of said excitation current with respect to the same circulation direction of said exciting coil and said canceling exciting coil; and wherein said exciting coil and said canceling exciting coil satisfy the following relationship as to the frequency of at least the alternating current $$L1=k1\times k1\times LL;$$

where k1 is a coefficient of coupling between said exciting coil and said canceling exciting coil, LL is a self-inductance of said exciting coil, and L1 is a self-inductance of said canceling exciting coil.

2. A shielding apparatus that shields flux leakage from a magnetic circuit that has an exciting coil through which an excitation current passes and that generates alternating flux, the shielding apparatus comprising:

a canceling exciting coil that generates canceling flux for canceling the flux leakage by applying a canceling current corresponding to said alternating flux;

wherein said exciting coil and said canceling exciting coil are connected in series;

wherein the canceling current is an alternating current of a phase opposite to a phase of said excitation current with respect to the same circulation direction of said exciting coil and said canceling exciting coil; and wherein said canceling exciting coil and said exciting coil satisfy the following relationship as to the frequency of at least the alternating current $$L1=k1\times k1\times LL/(\eta\times\eta),$$

where k1 is a coefficient of coupling between said exciting coil and said canceling exciting coil, LL is a self-inductance of said exciting coil, L1 is a self-inductance of said canceling exciting coil, and η is a far magnetic field coefficient that is a ratio of a far magnetic field component to total flux generated by said canceling exciting coil.

3. A shielding apparatus that shields flux leakage from a magnetic circuit that has an exciting coil through which an excitation current passes and that generates alternating flux, the shielding apparatus comprising:

a canceling exciting coil that generates canceling flux for canceling the flux leakage by applying a canceling current corresponding to said alternating flux;

wherein the canceling current is an alternating current of a phase virtually opposite to a phase of said excitation current with respect to the same circulation direction of said exciting coil and said canceling exciting coil; and a phase correction circuit configured to shift a phase of a canceling current flowing in said canceling exciting coil with respect to a phase of a current flowing in said exciting coil.

4. A shielding apparatus that shields flux leakage from a magnetic circuit that has an exciting coil through which an excitation current passes and that generates alternating flux, the shielding apparatus comprising:

a canceling exciting coil that generates canceling flux for canceling the flux leakage by applying a canceling current corresponding to said alternating flux;

wherein the canceling current is an alternating current of a phase virtually opposite to a phase of said excitation current with respect to the same circulation direction of said exciting coil and said canceling exciting coil;

an exciting coil current detection circuit that detects a current passing through said exciting coil; and a current processing circuit that processes a canceling current flowing in said canceling exciting coil in accordance with the current detected by said exciting coil current detection circuit.

5. The shielding apparatus according to claim 4, wherein said current processing circuit comprises at least one of a phase control circuit, an amplitude control circuit, and an amplifier circuit.

6. The shielding apparatus according to claim 5, wherein said current processing circuit comprises a canceling exciting coil voltage detection circuit that detects a voltage generated in said canceling exciting coil, and processes a canceling current flowing in said canceling exciting coil so that the voltage detected by said canceling exciting coil voltage detection circuit becomes minimal.

7. A shielding apparatus that shields flux leakage from a magnetic circuit that has an exciting coil through which an excitation current passes and that generates alternating flux, the shielding apparatus comprising:

a canceling exciting coil that generates canceling flux for canceling the flux leakage by applying a canceling current corresponding to said alternating flux;

wherein the canceling current is an alternating current of a phase virtually opposite to a phase of said excitation current with respect to the same circulation direction of said exciting coil and said canceling exciting coil;

an exciting coil voltage detection circuit that detects a voltage supplied to said exciting coil; and a current processing circuit that processes a canceling current flowing in said canceling exciting coil in accordance with the voltage detected by said exciting coil voltage detection circuit.

8. The shielding apparatus according to claim 7, wherein said current processing circuit comprises at least one of a phase control circuit, an amplitude control circuit, and an amplifier circuit.

9. The shielding apparatus according to claim 8, wherein said current processing circuit comprises a canceling exciting coil voltage detection circuit that detects a voltage generated in said canceling exciting coil, and processes a canceling current flowing in said canceling exciting coil so that the voltage detected by said canceling exciting coil voltage detection circuit becomes minimal.

10. A shielding apparatus that shields flux leakage from a magnetic circuit that has an exciting coil through which an excitation current passes and that generates alternating flux, the shielding apparatus comprising:

a canceling exciting coil that generates canceling flux for canceling the flux leakage by applying a canceling current corresponding to said alternating flux;

wherein the canceling current is an alternating current of a phase virtually opposite to a phase of said excitation current with respect to the same circulation direction of said exciting coil and said canceling exciting coil;

a flux detection circuit that detects alternating flux generated in said magnetic circuit; and a current processing circuit that processes a canceling current flowing in said canceling exciting coil in accordance with the flux detected by said flux detection circuit.

11. The shielding apparatus according to claim 10, wherein said current processing circuit comprises at least one of a phase control circuit, an amplitude control circuit, and an amplifier circuit.

12. The shielding apparatus according to claim 11, wherein said current processing circuit comprises a canceling exciting coil voltage detection circuit that detects a voltage generated in said canceling exciting coil, and processes a canceling current flowing in said canceling exciting coil so that the voltage detected by said canceling exciting coil voltage detection circuit becomes minimal.

13. A shielding apparatus that shields flux leakage from a magnetic circuit that has an exciting coil through which an excitation current passes and that generates alternating flux, the shielding apparatus comprising:

a canceling exciting coil that generates canceling flux for canceling the flux leakage by applying a canceling current corresponding to said alternating flux;

wherein the canceling current is an alternating current of a phase virtually opposite to a phase of said excitation current with respect to the same circulation direction of said exciting coil and said canceling exciting coil;

a mutually induced electromotive force detection circuit that detects a mutually induced electromotive force induced within said canceling exciting coil; and a current processing circuit that processes a canceling current flowing in said canceling exciting coil in accordance with the mutually induced electromotive force detected by said mutually induced electromotive force detection circuit.

14. The shielding apparatus according to claim 13, further comprising:

a bridge circuit that includes said canceling exciting coil; and a voltage detection circuit that detects a voltage of said bridge circuit, wherein the following relationship is satisfied as to the frequency of at least the alternating current $$L1 \times Z3 = Z1 \times Z2$$

where, in said bridge circuit, L1 is an impedance of said canceling exciting coil, an impedance Z1 is located adjacent to inductance L1 and on one side thereof, an impedance Z2 is located on the opposite side of impedance L1, and impedance Z3 is located opposite impedance L1;

said mutually induced electromotive force detection circuit is configured to detect a potential difference between a point of connection of impedance L1 and impedance Z1 and a point of connection of impedance Z2 and impedance Z3; and said current processing circuit is connected in parallel to a series circuit consisting of impedance L1 and impedance Z1, and a series circuit consisting of impedance Z2 and impedance Z3.

15. The shielding apparatus according to claim 14, wherein impedances Z1, Z2, and Z3 of said bridge circuit are each a coil, a capacitor, or both.

16. The shielding apparatus according to claim 14, wherein impedance Z3 and either impedance Z1 or impedance Z2 of said bridge circuit are resistances.

17. The shielding apparatus according to claim 13, wherein said current processing circuit comprises at least one of a phase control circuit, an amplitude control circuit, and an amplifier circuit.

18. The shielding apparatus according to claim 17, wherein said current processing circuit comprises a canceling exciting coil voltage detection circuit that detects a voltage generated in said canceling exciting coil, and processes a canceling current flowing in said canceling exciting coil so that the voltage detected by said canceling exciting coil voltage detection circuit becomes minimal.

19. A shielding apparatus that shields flux leakage from a magnetic circuit that has an exciting coil through which an excitation current passes and that generates alternating flux, the shielding apparatus comprising:

a canceling exciting coil that generates canceling flux for canceling the flux leakage by applying a canceling current corresponding to said alternating flux;

wherein the canceling current is an alternating current of a phase virtually opposite to a phase of said excitation current with respect to the same circulation direction of said exciting coil and said canceling exciting coil;

a synchronization signal generation circuit that generates a synchronization signal synchronized with a current flowing through said magnetic circuit;

a canceling exciting coil drive signal generation circuit that generates a drive signal that drives said canceling exciting coil based on the synchronization signal output by said synchronization signal generation circuit; and a current processing circuit that processes the canceling current flowing in said canceling exciting coil in accordance with the drive signal output by said canceling exciting coil drive signal generation circuit.

20. The shielding apparatus according to claim 19, wherein said current processing circuit comprises at least one of a phase control circuit, an amplitude control circuit, and an amplifier circuit.

21. The shielding apparatus according to claim 20, wherein said current processing circuit comprises a canceling exciting coil voltage detection circuit that detects a voltage generated in said canceling exciting coil, and processes a canceling current flowing in said canceling exciting coil so that the voltage detected by said canceling exciting coil voltage detection circuit becomes minimal.

22. A shielding apparatus that shields flux leakage from a magnetic circuit that has an exciting coil through which an excitation current passes and that generates alternating flux, the shielding apparatus comprising:

a canceling exciting coil that generates canceling flux for canceling the flux leakage by applying a canceling current corresponding to said alternating flux; and wherein the following relationship is satisfied $$|Vi| < 0.000001774799 \times f \times n / r2$$

where Vi is a voltage obtained by excluding a voltage generated by a resistance component of said canceling exciting coil from an alternating voltage generated at either end of said canceling exciting coil through which said canceling current passes, f is an alternation frequency of said canceling current, n is a number of turns of said canceling exciting coil, and r2 is a canceling exciting coil equivalent circular loop radius.

23. A shielding apparatus that shields flux leakage from a magnetic circuit that has an exciting coil through which an excitation current passes and that generates alternating flux, the shielding apparatus comprising:

a canceling exciting coil that generates canceling flux for canceling the flux leakage by applying a canceling current corresponding to said alternating flux;

wherein the following relationship is satisfied $$|\eta Vi + (1-\eta) Vf| < 0.000001774799 \times f \times n / r2 (V),$$

Where Vi is a voltage obtained by excluding a voltage generated by a resistance component of said canceling exciting coil from an alternating voltage generated at either end of said canceling exciting coil through which said canceling current passes, Vf is a mutually induced electromotive force generated by the flux leakage, f is an alternation frequency of said canceling current, n is a number of turns of said canceling exciting coil, r2 is a canceling exciting coil equivalent circular loop radius, and $\eta$ is a ratio of a far magnetic field component to total flux generated by said canceling exciting coil.

24. A shielding apparatus that shields flux leakage from a magnetic circuit that has an exciting coil through which an excitation current passes and that generates alternating flux, the shielding apparatus comprising:

a canceling exciting coil that generates canceling flux for canceling the flux leakage by applying a canceling current corresponding to said alternating flux; and said canceling exciting coil is positioned, via an electrical member, at a position at which said canceling flux overlaps the flux leakage.

25. The shielding apparatus according to claim 24, said electrical member comprising an electrical insulator.

26. A shielding method that cancels flux leakage from a magnetic circuit that generates alternating flux, the method comprising:

cancelling the flux leakage by cancelling flux generated in a canceling exciting coil by applying a canceling current corresponding to the alternating flux to the canceling exciting coil, and generating the canceling current such that an alternating voltage generated in the canceling exciting coil becomes minimal.

27. A shielding method that cancels flux leakage from a magnetic circuit that generates alternating flux, the method comprising:

cancelling the flux leakage by cancelling flux generated in a canceling exciting coil by applying a canceling current corresponding to the alternating flux to the canceling exciting coil, and generating the canceling current so as to minimize a difference between a voltage generated in the canceling exciting coil and a voltage $(1-\eta)/\eta$ times a mutually induced electromotive force generated in the canceling exciting coil, where $\eta$ is a far magnetic field coefficient that is a ratio of a far magnetic field component to total flux generated by said canceling exciting coil.

28. An induction heating apparatus in which a heating unit performs induction heating of a member to be heated, said heating unit having an exciting coil through which an excitation current passes and that generates alternating flux, the induction heating apparatus comprising:

a canceling exciting coil that generates canceling flux for canceling the flux leakage by applying a canceling current corresponding to said alternating flux;

wherein said exciting coil and said canceling exciting coil are connected in series; and wherein the canceling current is an alternating current of an opposite phase to a phase of said excitation current with respect to the same circulation direction of said exciting coil and said canceling exciting coil.

29. A fixing apparatus comprising the induction heating apparatus according to claim 28, wherein the member to be heated by said heating unit of said induction heating apparatus is configured to perform induction heating to fix toner on an image-bearing body.

30. An image forming apparatus comprising the fixing apparatus according to claim 29, the fixing apparatus being configured to fix toner on an image-bearing body to form an image.

31. An induction heating apparatus in which a heating unit performs induction heating of a member to be heated, said heating unit having an exciting coil through which an excitation current passes and that generates alternating flux, wherein said heating unit further comprises a canceling exciting coil that generates canceling flux for canceling flux leakage by applying a canceling current corresponding to said alternating flux, the flux leakage leaking from a magnetic circuit containing said exciting coil;

wherein the canceling current is an alternating current of a phase opposite to a phase of said excitation current with respect to the same circulation direction of said exciting coil and said canceling exciting coil; and wherein the induction heating apparatus comprises a phase correction circuit that shifts a phase of a canceling current flowing in said canceling exciting coil with respect to a phase of a current flowing in said exciting coil.

32. A fixing apparatus comprising the induction heating apparatus according to claim 31, wherein the member to be heated by said heating unit of the induction heating apparatus is configured to perform induction heating to fix toner on an image-bearing body.

33. An image forming apparatus comprising the fixing apparatus according to claim 32, the fixing apparatus being configured to fix toner on an image-bearing body to form an image.

34. A shielding apparatus that shields flux leakage from a magnetic circuit that has an exciting coil through which an excitation current passes and that generates alternating flux, the shielding apparatus comprising:

a canceling exciting coil that generates canceling flux for canceling the flux leakage by applying a canceling current corresponding to said alternating flux; and a canceling magnetic field generation circuit that supplies the canceling current, wherein said canceling magnetic field generation circuit supplies, as the canceling current, a current such that an alternating voltage generated at both ends of the canceling exciting coil becomes substantially equal to a product of a direct current resistance of the canceling exciting coil and the canceling current.

* * * * *